US010418733B2

(12) United States Patent
Ishimaru

(10) Patent No.: US 10,418,733 B2
(45) Date of Patent: Sep. 17, 2019

(54) ELECTRIC CONNECTOR WITH CONTACT MEMBERS HAVING DIFFERENT THICKNESS

(71) Applicant: DAI-ICHI SEIKO CO.,LTD., Kyoto-shi, Kyoto (JP)

(72) Inventor: Masao Ishimaru, Machida (JP)

(73) Assignee: DAI-ICHI SEIKO CO., LTD., Kyoto-shi, Kyoto (JP)

( * ) Notice: Subject to any disclaimer, the term of this patent is extended or adjusted under 35 U.S.C. 154(b) by 0 days.

(21) Appl. No.: 15/757,370

(22) PCT Filed: Jun. 3, 2016

(86) PCT No.: PCT/JP2016/066589
§ 371 (c)(1),
(2) Date: Mar. 5, 2018

(87) PCT Pub. No.: WO2017/006672
PCT Pub. Date: Jan. 12, 2017

(65) Prior Publication Data

US 2018/0254572 A1 Sep. 6, 2018

(30) Foreign Application Priority Data

Jul. 8, 2015 (JP) ..... 2015-136599

(51) Int. Cl.
*H01R 12/72* (2011.01)
*H01R 12/79* (2011.01)
(Continued)

(52) U.S. Cl.
CPC ..... *H01R 12/721* (2013.01); *H01R 12/57* (2013.01); *H01R 12/7011* (2013.01);
(Continued)

(58) Field of Classification Search
CPC ..... H01R 9/091; H01R 12/57; H01R 12/707; H01R 12/7011; H01R 12/79; H01R 12/88; H01R 4/028; H01R 12/721
(Continued)

(56) References Cited

U.S. PATENT DOCUMENTS 4,196,955 A * 4/1980 Anhalt ..... H01R 12/89 439/267
5,830,014 A * 11/1998 Lwee ..... B23K 1/0016 439/876
(Continued)

FOREIGN PATENT DOCUMENTS

JP H11-204204 7/1999
JP H11-307198 11/1999
(Continued)

OTHER PUBLICATIONS

English translation of JP 2006-040687 dated Feb. 9, 2006.*
(Continued)

*Primary Examiner* — Harshad C Patel
(74) *Attorney, Agent, or Firm* — Soei Patent & Law Firm

(57) ABSTRACT

To be capable of easily avoiding lengthening and heightening with a simple configuration even in a case where relatively large electric power is supplied.
Provided is a configuration in which the conductor resistance of a plurality of contact members 13 and 14 is reduced in accordance with an increment in thickness and energization allowable electric power is increased by one of more of the contact members 13 and 14 being formed thicker than the rest so that an increase in the size of an electric connector such as lengthening and heightening is prevented even in a case where the supply electric power with respect to the electric connector is large and the retention of a flat plate-shaped signal transmission medium F is enhanced by contact
(Continued)

portions of the thickness-increased contact members 13 and 14 being pressure-welded to the flat plate-shaped signal transmission medium F.

23 Claims, 20 Drawing Sheets

(51) Int. Cl.

| | |
|---|---|
| ***H01R 12/57*** | (2011.01) |
| ***H01R 12/70*** | (2011.01) |
| *H01R 12/88* | (2011.01) |
| *H01R 4/02* | (2006.01) |
| *H01R 12/71* | (2011.01) |
| *H01R 12/77* | (2011.01) |

(52) U.S. Cl.
CPC ..... *H01R 12/79* (2013.01); *H01R 4/028* (2013.01); *H01R 12/707* (2013.01); *H01R 12/716* (2013.01); *H01R 12/774* (2013.01); *H01R 12/88* (2013.01)

(58) Field of Classification Search
USPC ..... 439/78, 83, 84, 267, 492, 325, 326, 329, 439/331
See application file for complete search history.

(56) References Cited

U.S. PATENT DOCUMENTS

| | | | | |
|---|---|---|---|---|
| 8,292,654 | B2 * | 10/2012 | Yasui | H01R 12/724 439/378 |
| 8,323,044 | B2 * | 12/2012 | Tsunemura | H01R 12/79 439/267 |
| 2010/0029128 | A1 | 2/2010 | Takahira et al. | |
| 2012/0077366 | A1 | 3/2012 | Tsunemura | |
| 2012/0231646 | A1 * | 9/2012 | Nakano | H01R 12/79 439/267 |
| 2014/0057475 | A1 * | 2/2014 | Tohjo | H01R 12/88 439/329 |
| 2015/0180149 | A1 * | 6/2015 | Nakamura | H01R 23/684 439/267 |

FOREIGN PATENT DOCUMENTS

| | | |
|---|---|---|
| JP | 2006-040687 | 2/2006 |
| JP | 2012-069481 | 4/2012 |
| JP | 4908621 | 4/2012 |
| JP | 2012-089264 | 5/2012 |

OTHER PUBLICATIONS

English translation of JP 11-307198 dated 1999-11-05l.*
English translation of JP 11-204204 dated Jul. 30, 1999.*
International Preliminary Report on Patentability with Written Opinion dated Sep. 6, 2016 for PCT/JP2016/066589.
Extended Search Report in corresponding European Application No. 16821143.1, dated Mar. 13, 2019.

* cited by examiner

ELECTRIC CONNECTOR WITH CONTACT MEMBERS HAVING DIFFERENT THICKNESS

CROSS-REFERENCE TO RELATED APPLICATIONS

This application is a 35 U.S.C. § 371 national phase application of PCT/JP2016/066589, filed Jun. 3, 2016, which is based upon and claims the benefit of priority from Japanese Patent Application No. 2015-136599, filed Jul. 8, 2015.

TECHNICAL FIELD

The present invention relates to an electric connector configured such that clamping is performed by contact members being pressure-welded to both side surfaces of a flat plate-shaped signal transmission medium inserted into an insulating housing for sandwiching from both sides.

BACKGROUND ART

In general, various electric connectors are widely used in various types of electrical equipment, devices, and so on for electrical connection of a signal transmission medium having a flat plate shape (hereinafter, referred to as a flat plate-shaped signal transmission medium) such as a flexible printed circuit (FPC) and a flexible flat cable (FFC). For example, in an electric connector that is mounted and used on a printed wiring substrate as in Patent Literature 1 below, the flat plate-shaped signal transmission medium including the FPC, the FFC, and so on is inserted from an opening for medium insertion disposed at the front end part of an insulating housing (insulator). The flat plate-shaped signal transmission medium is inserted to be pinched at the part between a lower beam and an upper beam constituting contact members. Subsequently, the contact members are elastically displaced by, for example, an actuator (connection operation means) being rotated by a worker's operating force, and the upper beam and the lower beam of the elastically displaced contact members are put into a state of being pressure-welded to both surfaces of the flat plate-shaped signal transmission medium (FPC, FFC, and so on). Clamping of the flat plate-shaped signal transmission medium is performed as a result.

In a state where the flat plate-shaped signal transmission medium (FPC, FFC, or the like) is clamped by the contact members of the electric connector as described above, the contact members are electrically connected with respect to a signal pattern disposed in the flat plate-shaped signal transmission medium. As a result, a state occurs where the flat plate-shaped signal transmission medium is electrically connected to the wiring substrate side through one end portion of the contact member solder-connected to a conductive path on the wiring substrate, and signal transmission is performed with the electric connector interposed.

Nowadays, contact members arranged in a multipolar shape tend to be disposed at a narrow pitch in electric connectors as a significant decrease in size and height is in progress. Once each contact member is reduced in size and thickness so that the narrow-pitch contact member disposition is realized in this regard, the conductor resistance of the contact members increases and the resultant heat generation may lead to a rise in electric connector temperature. Accordingly, in existing electric connectors, a configuration in which a plurality of contact members is energized with a single transmission signal is adopted sometimes as means for reducing the conductor resistance of the contact members. A rise in temperature during signal transmission can be suppressed with an energization structure that is based on a plurality of contact members as described above.

As a matter of course, however, the adoption of a configuration in which a plurality of contact members is used for the transmission of a single signal causes the number of the contact members to increase, and then a problem arises in the form of the lengthening or heightening of an electric connector as a whole.

CITATION LIST

Patent Literature

Patent Literature 1: Japanese Unexamined Patent Publication No. 2012-069481

SUMMARY OF INVENTION

Technical Problem

An object of the present invention is to provide an electric connector with which lengthening and heightening can be easily avoided with a simple configuration even in a case where relatively large electric power is supplied.

Solution to Problem

In order to achieve the above object, the present invention adopts a configuration of an electric connector in which a plurality of contact members mounted on an insulating housing is arranged in a multipolar shape along a thickness direction of the contact members, the electric connector being configured such that clamping of a flat plate-shaped signal transmission medium is performed by a pair of contact portions disposed in the contact members being pressure-welded to both side surfaces of the flat plate-shaped signal transmission medium inserted into the insulating housing for sandwiching from both sides, in which one or more of the plurality of contact members are formed thicker than the rest of the contact members.

According to the present invention that has the configuration described above, the conductor resistance of the thickness-increased thicker contact members is reduced in accordance with an increment in thickness, and thus the allowable electric power energization of the electric connector increases and the number of the contact members does not have to be increased even in a case where the electric power supply with respect to the electric connector is relatively large. Accordingly, an increase in the size of the electric connector such as lengthening and heightening can be suppressed. In addition, the contact portions of the thickness-increased thicker contact members are pressure-welded to the flat plate-shaped signal transmission medium inserted into the insulating housing, and thus the contact pressure of the contact members with respect to the flat plate-shaped signal transmission medium increases, and the retention of the flat plate-shaped signal transmission medium is enhanced as a result.

Desirably, in the present invention, the number of the contact members formed thicker than the rest of the contact members is two and the thicker contact members are disposed to sandwich the rest of the contact members in an arrangement direction of the multipolar shape.

According to the present invention that has the configuration described above, the contact portions of the two contact members realizing a relatively large contact pressure with respect to the flat plate-shaped signal transmission medium by having an increased thickness are put into a state of being pressure-welded to the flat plate-shaped signal transmission medium to sandwich the rest of the contact members, and thus misalignment such as rotation of the flat plate-shaped signal transmission medium is prevented in a plane including a surface of the flat plate-shaped signal transmission medium.

Desirably, in the present invention, the two contact members are disposed at outermost end positions on both sides in the arrangement direction of the multipolar shape.

According to the present invention that has the configuration described above, the contact portions of the two contact members realizing a relatively large contact pressure with respect to the flat plate-shaped signal transmission medium by having an increased thickness are put into a state of being pressure-welded to the flat plate-shaped signal transmission medium at the outermost end positions on both sides in the arrangement direction of the multipolar shape, that is, at the outer end positions on both sides in the width direction of the flat plate-shaped signal transmission medium, and thus misalignment in the direction of rotation of the flat plate-shaped signal transmission medium is prevented in an even more satisfactory manner.

Desirably, in the present invention, a gap S between the pair of contact portions disposed in the contact members formed thicker than the rest of the contact members is set equal to or less than a thickness T of the flat plate-shaped signal transmission medium ($S \leq T$).

According to the present invention that has the configuration described above, immediately after the flat plate-shaped signal transmission medium is inserted into the insulating housing, the flat plate-shaped signal transmission medium is immediately put into a state of abutting against the contact portions of the thickness-increased thicker contact members. Accordingly, the flat plate-shaped signal transmission medium is temporarily held by the relatively large contact pressure of the contact portions of the thicker contact members, and the flat plate-shaped signal transmission medium is stably held between the insertion of the flat plate-shaped signal transmission medium and the completion of the clamping.

Desirably, in the present invention, the rest of the contact members and the contact members formed thicker than the rest of the contact members have the same shape when seen in the arrangement direction of the multipolar shape.

According to the present invention that has the configuration described above, the thickness-increased thicker contact members and the rest of the contact members can be assembled in the same manner.

Desirably, in the present invention, each of the plurality of contact members including the rest of the contact members and the contact members formed thicker than the rest of the contact members is formed of any one of two types of contact members having different shapes when seen in the arrangement direction of the multipolar shape.

According to the present invention that has the configuration described above, a configuration of so-called staggered arrangement can be adopted in which the thickness-increased thicker contact members are mixed in the arrangement direction of the multipolar shape and, for example, the directions of the contact members are alternately disposed.

Advantageous Effects of Invention

As described above, in the electric connector according to the present invention, one or more of the plurality of contact members are formed thicker than the rest of the contact members, and thus the conductor resistance of the thickness-increased contact members is reduced in accordance with an increment in thickness. As a result, the number of the contact members does not have to be increased even in a case where the supply electric power with respect to the electric connector is relatively large, and an increase in the size of the electric connector such as lengthening and heightening can be suppressed. In addition, the electric connector according to the present invention is configured such that the contact pressure of the contact members with respect to the flat plate-shaped signal transmission medium is increased and the retention of the flat plate-shaped signal transmission medium is enhanced by the thickness-increased contact members being pressure-welded to the flat plate-shaped signal transmission medium inserted into the insulating housing, and thus lengthening and heightening of the electric connector can be easily avoided with a simple configuration even in a case where the supply electric power is relatively large. As a result, the reliability of the electric connector can be enhanced to a significant extent and in an inexpensive manner.

DESCRIPTION OF EMBODIMENTS

Figure 1:
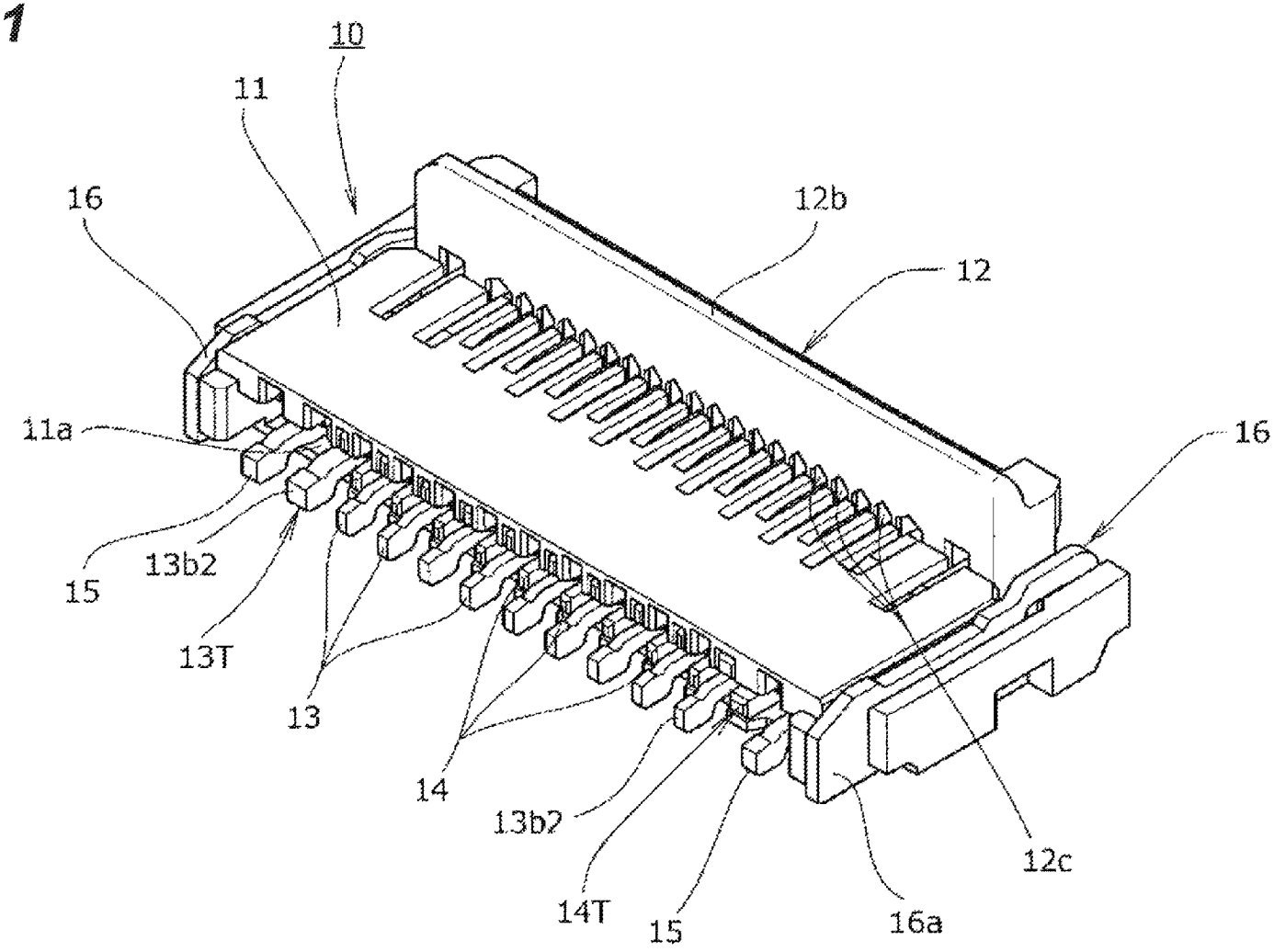
FIG. 1 is an external perspective explanatory drawing illustrating a state where an actuator is upright at an "initial standby position" in an electric connector according to an embodiment of the present invention and illustrating an overall configuration in a case where no signal transmission medium is inserted from the connector front side.
Figure 2:
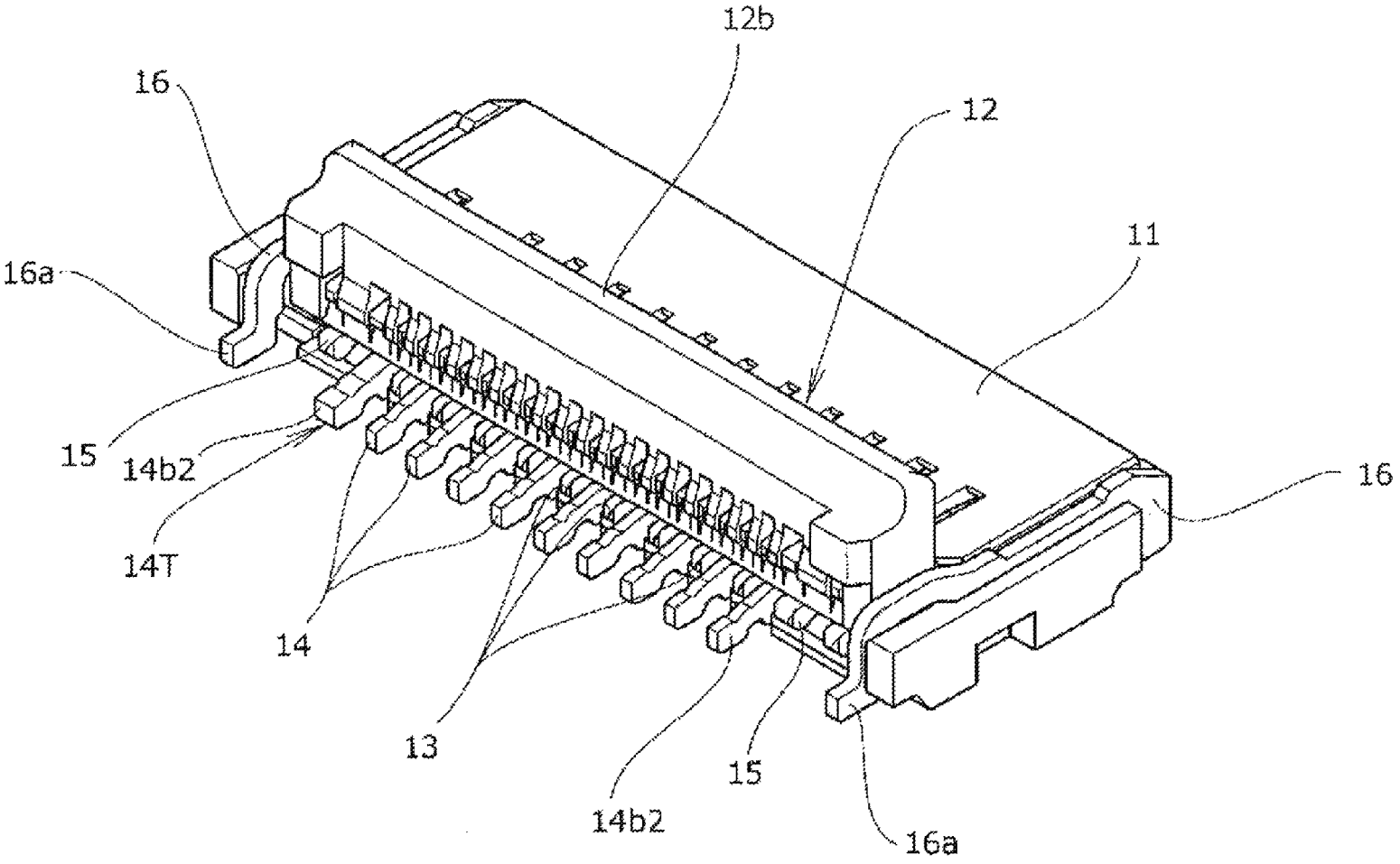
FIG. 2 is an external perspective explanatory drawing illustrating the electric connector illustrated in FIG. 1 from the connector rear side.
Figure 3:
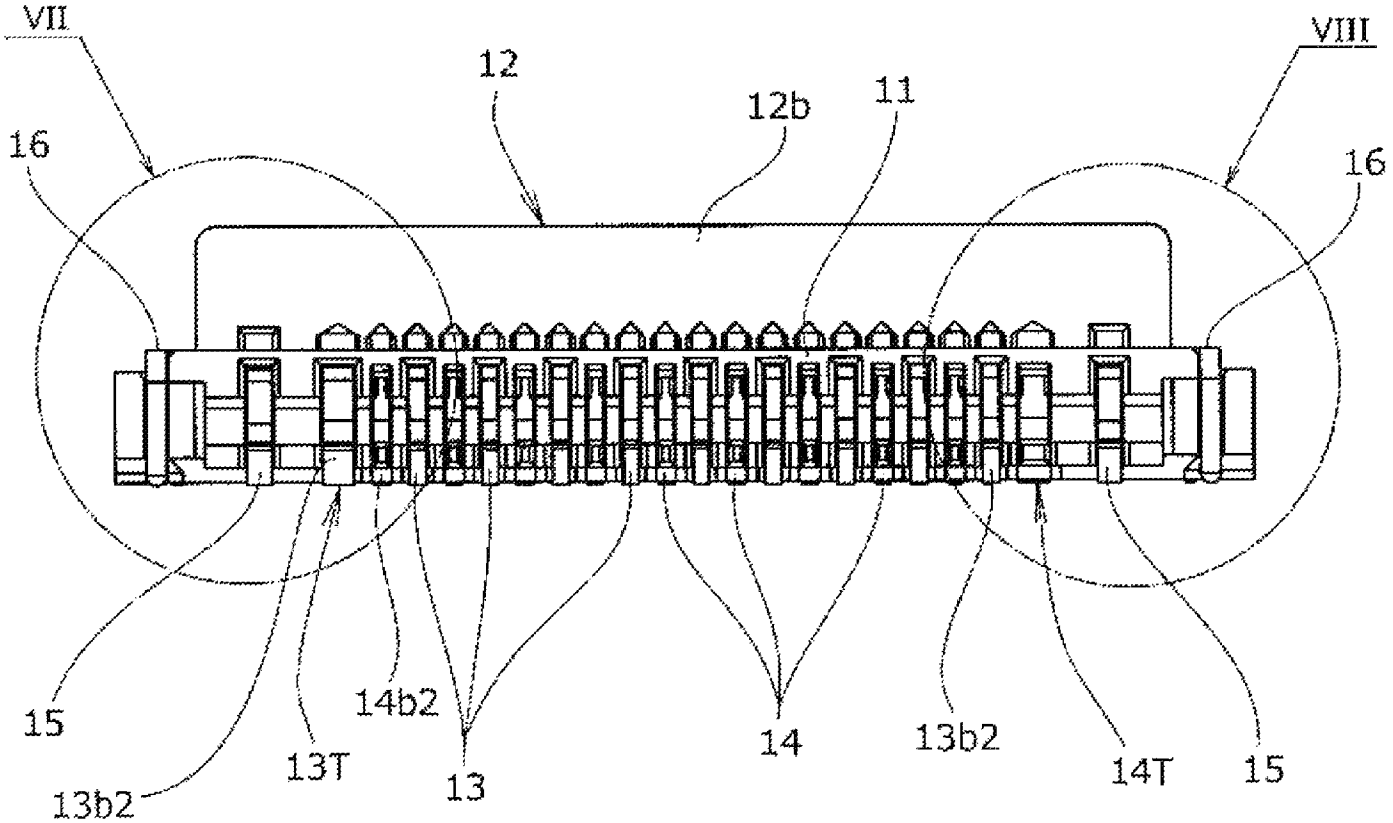
FIG. 3 is a front explanatory drawing at a time when the electric connector illustrated in FIGS. 1 and 2 is seen from the connector front side.
Figure 4:
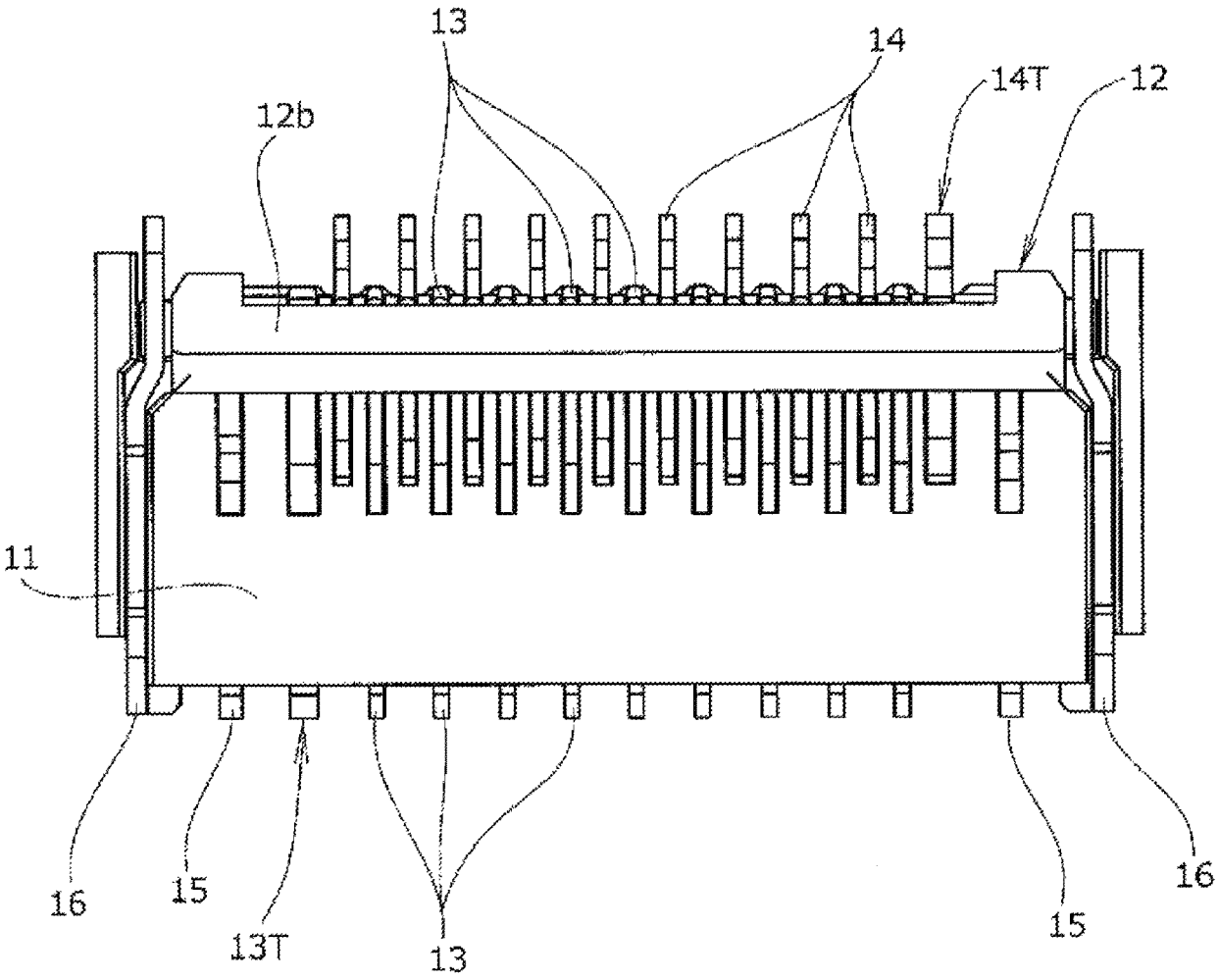
FIG. 4 is a plan explanatory drawing at a time when the electric connector illustrated in FIGS. 1 and 2 is seen from the connector upper side.

Hereinafter, an embodiment in which the present invention is applied to an electric connector mounted and used on a surface of a printed wiring substrate so that connection of a flat plate-shaped signal transmission medium including a flexible printed circuit (FPC), a flexible flat cable (FFC), and so on is performed will be described in detail based on the drawings.

An electric connector 10 illustrated in FIGS. 1 to 8 is an electric connector including a so-called back flip-type structure and provided with an actuator 12 as connection operation means on the rear end edge side of an insulating housing 11 (right end edge side in FIGS. 5 and 6), and the actuator 12 described above is configured to be rotated to be pushed down toward the rear side (right side in FIGS. 5 and 6) that is on the side opposite to the connector front end side (left end side in FIGS. 5 and 6) on which a terminal part of a flat plate-shaped signal transmission medium (FPC, FFC, or the like) F is inserted.

Although a hollow frame-shaped insulating member extending in an elongated shape forms the insulating housing 11 at this time, the longitudinal breadth direction of the insulating housing 11 will be referred to as a "connector longitudinal direction" below, and the direction in which the terminal part of the flat plate-shaped signal transmission medium (FPC, FFC, or the like) F is inserted and extracted will be referred to as a "connector front" or a "connector back". In addition, the height direction that is vertically away from the surface of a printed wiring substrate on which the electric connector 10 is mounted will be referred to as an "upward direction" and the direction that is opposite thereto will be referred to as a "downward direction".

In the insulating housing 11 described above, a plurality of first and second conductive contact members 13 and 14 divided into two types, formed of thin plate-shaped metallic members, and having different shapes is arranged to form a multipolar shape. The first and second conductive contact members 13 and 14 are mounted at appropriate intervals along the "connector longitudinal direction" in the insulating housing 11 and form a structure of so-called staggered arrangement in which the first conductive contact members 13 and the second conductive contact members 14 that have the different shapes are alternately arranged in the "connector longitudinal direction", which is the arrangement direction of the multipolar shape.

Each of the first and second conductive contact members 13 and 14 is used for either signal transmission or ground connection and is joined by solder bonding to a wiring land portion (conductive path) formed on the printed wiring substrate, which is not illustrated, and the electric connector 10 is put into a mounting state as a result.

A medium insertion port 11*a* into which the terminal part of the signal transmission medium F including the flexible printed circuit (FPC), the flexible flat cable (FFC), and so on as described above is inserted is disposed on the front end edge side of the insulating housing 11 (left end edge side in FIGS. 5 and 6) to form a transversely elongated shape in the connector longitudinal direction, and a part mounting port for mounting of the conductive contact member 13 described above, the actuator (connection operation means) 12 described above, and so on is formed also in a transversely elongated shape on the rear end edge side in the connector front-rear direction (right end edge side in FIGS. 5 and 6) that is on the side opposite thereto.

Figure 17:
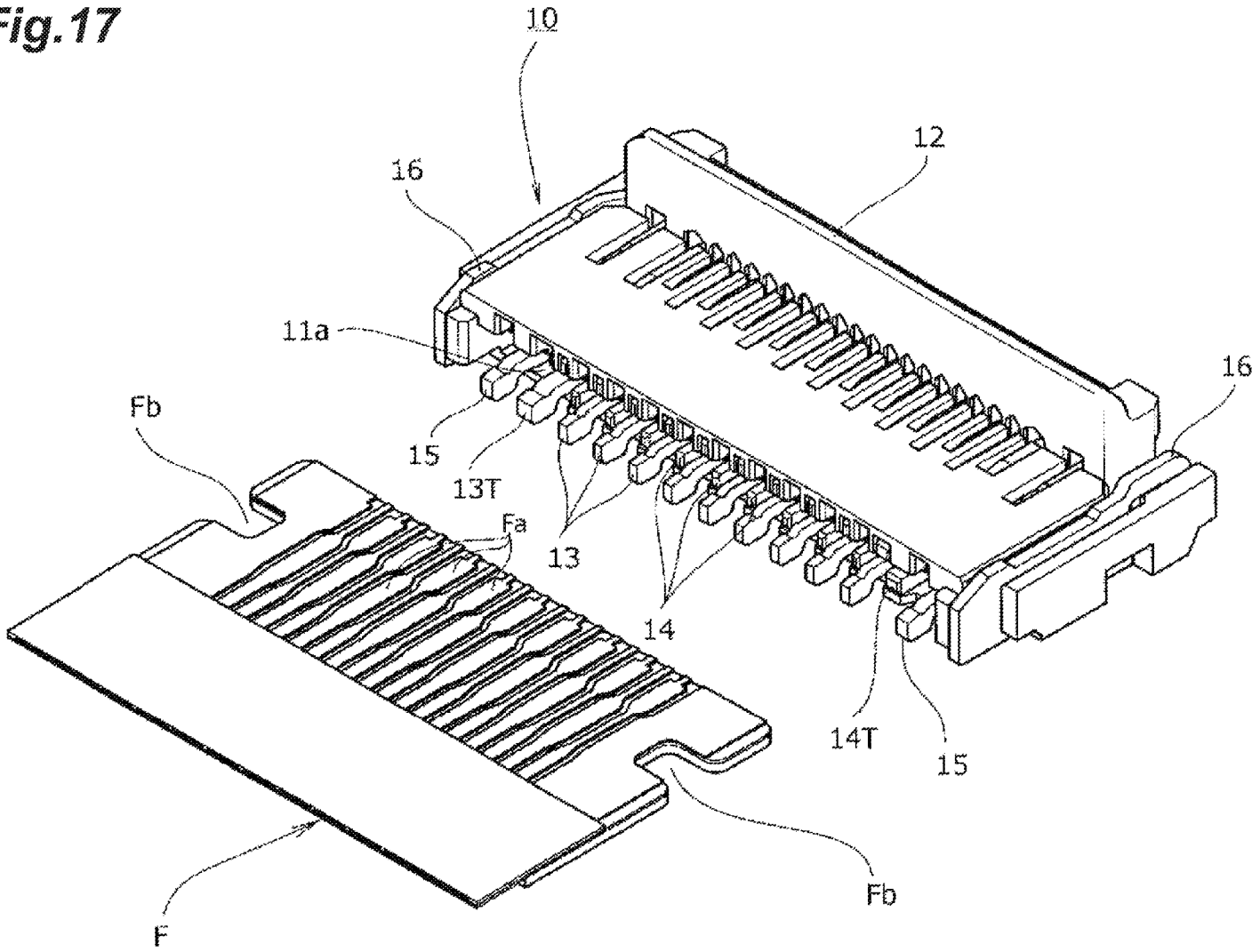
FIG. 17 is an external perspective explanatory drawing illustrating a state where a terminal part of a flat plate-shaped signal transmission medium (FPC, FFC, or the like) is yet to be inserted with respect to the electric connector according to the present invention.

Although the first conductive contact member 13 described above is mounted by being inserted toward the connector rear side (right side in FIG. 5) from the medium insertion port 11*a* disposed on the connector front end side of the insulating housing 11, the second conductive contact member 14 is mounted by being inserted toward the connector front side (left side in FIG. 6) from the part mounting port disposed on the connector rear end side of the insulating housing 11. Each of the first and second conductive contact members 13 and 14 is disposed at a position corresponding to a transmission pattern Fa (refer to FIG. 17) formed in the flat plate-shaped signal transmission medium (FPC, FFC, or the like) F inserted into the insulating housing 11, and the transmission patterns Fa formed in the flat plate-shaped signal transmission medium F have a configuration in which wiring land portions for signal transmission (signal line pads) or wiring land portions for shielding (shield wire pads) are disposed at appropriate pitch intervals.

Figure 5:
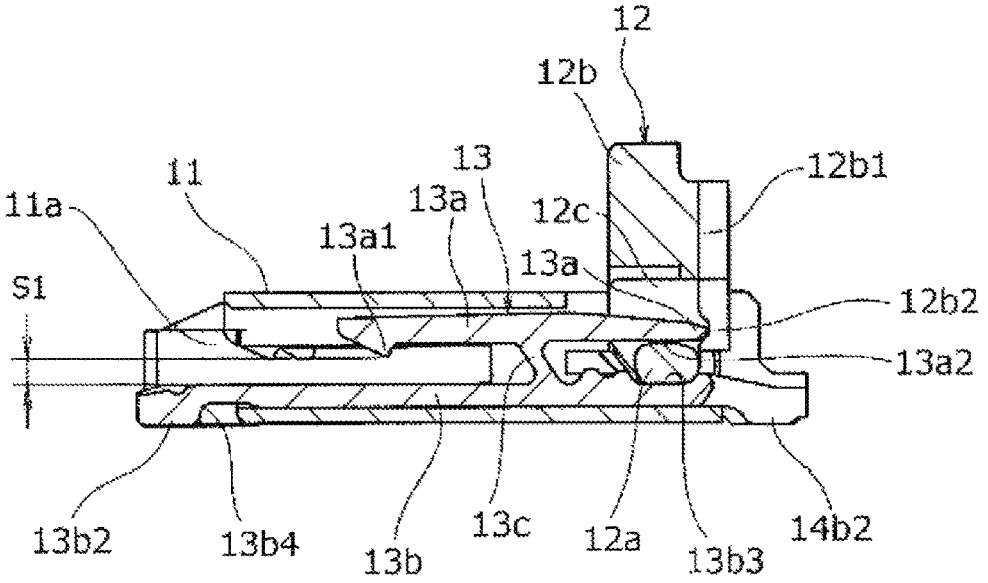
FIG. 5 is a cross-sectional explanatory drawing taken along line V-V of FIG. 4.
Figure 6:
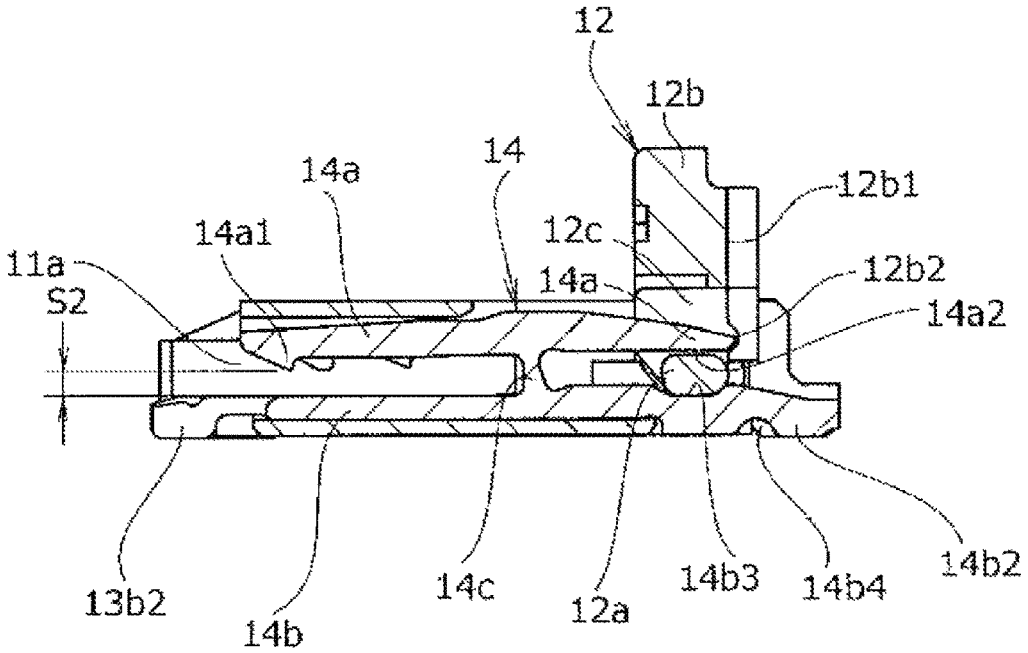
FIG. 6 is a cross-sectional explanatory drawing taken along line VI-VI of FIG. 4.
Figure 7:
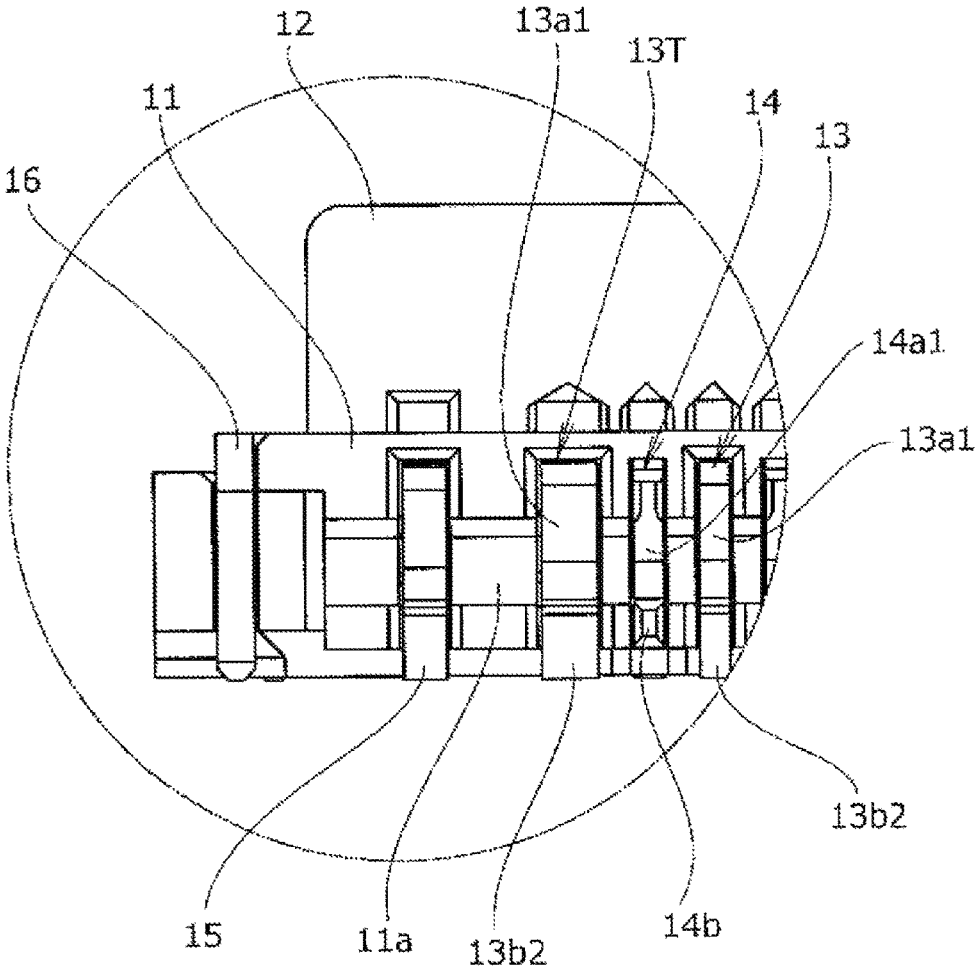
FIG. 7 is a partial front enlarged explanatory drawing of the VII region that is illustrated in FIG. 3.
Figure 8:
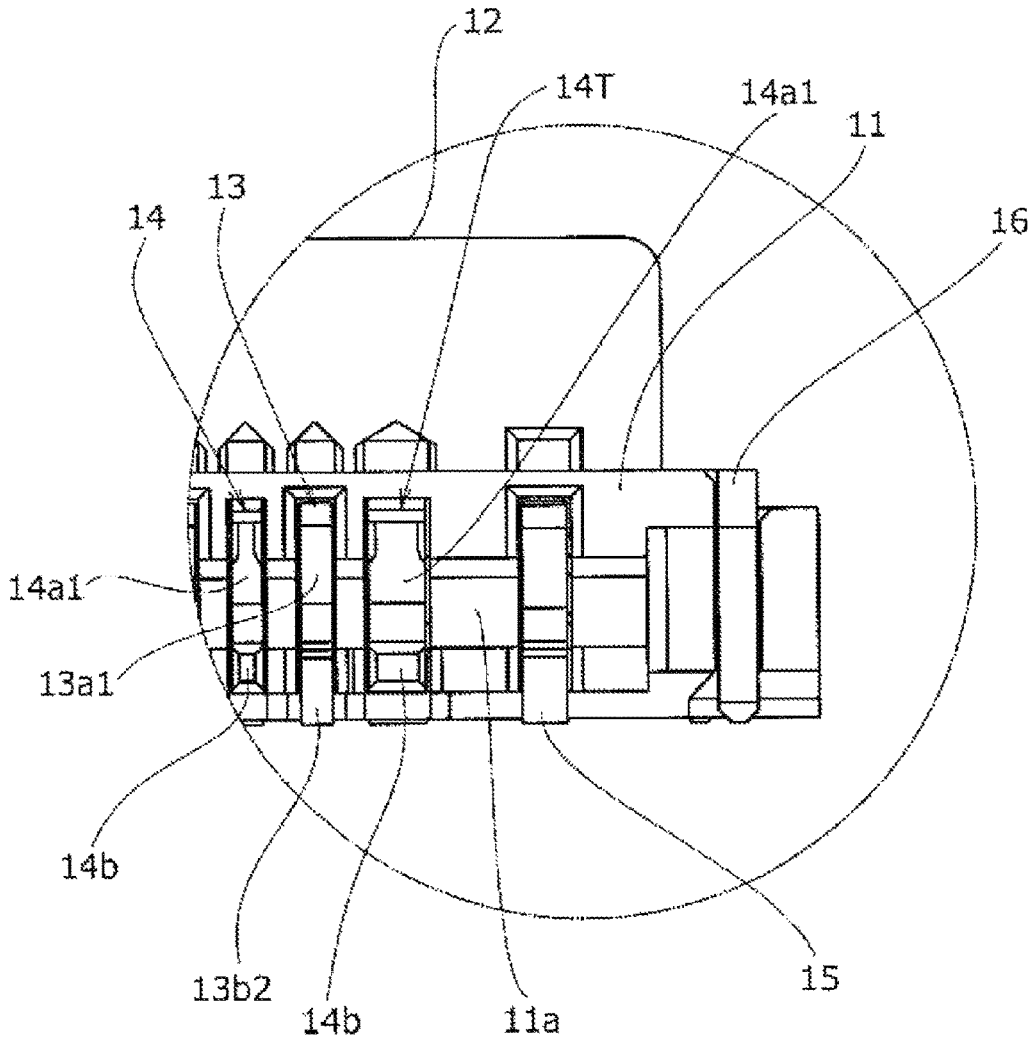
FIG. 8 is a partial front enlarged explanatory drawing of the VIII region that is illustrated in FIG. 3.
Figure 9:
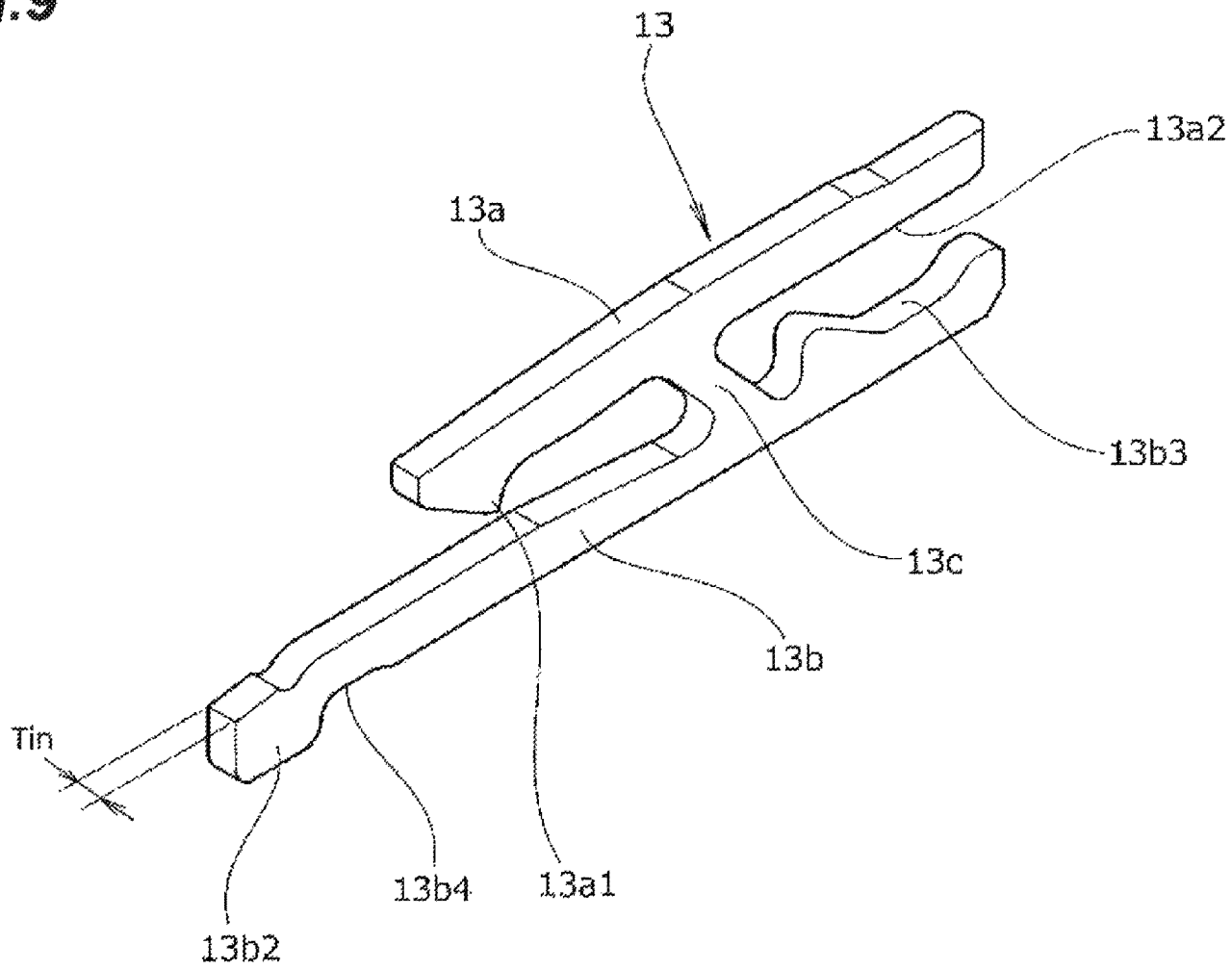
FIG. 9 is an enlarged external perspective explanatory drawing illustrating a first conductive contact member used in the electric connector according to the embodiment of the present invention illustrated in FIGS. 1 to 8 from the connector front side.
Figure 10:
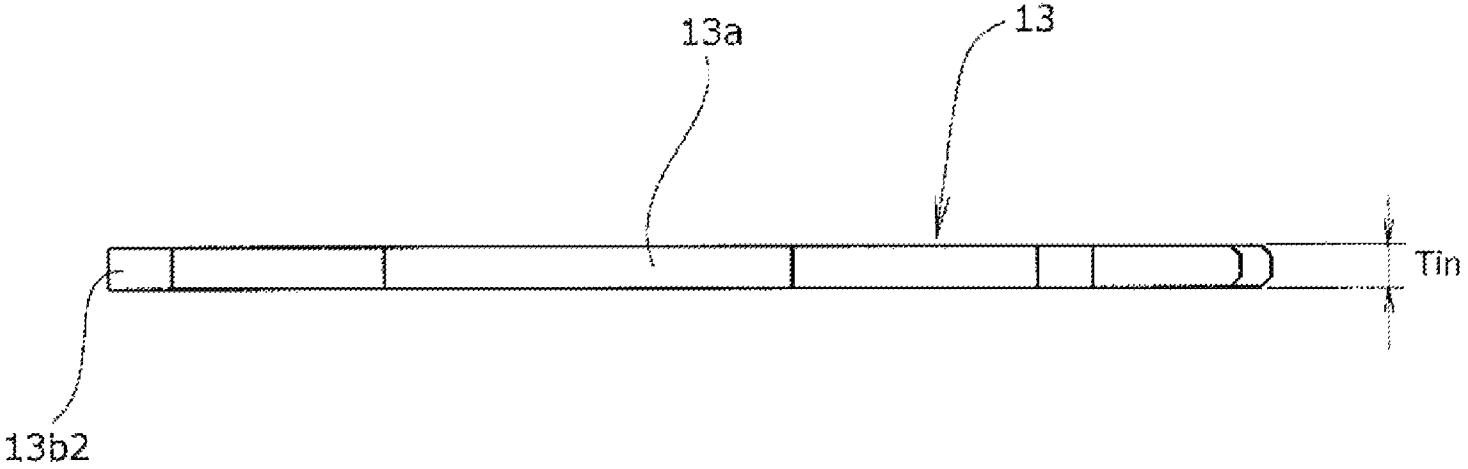
FIG. 10 is an enlarged side explanatory drawing in which the first conductive contact member illustrated in FIG. 9 is illustrated in side view.
Figure 11:
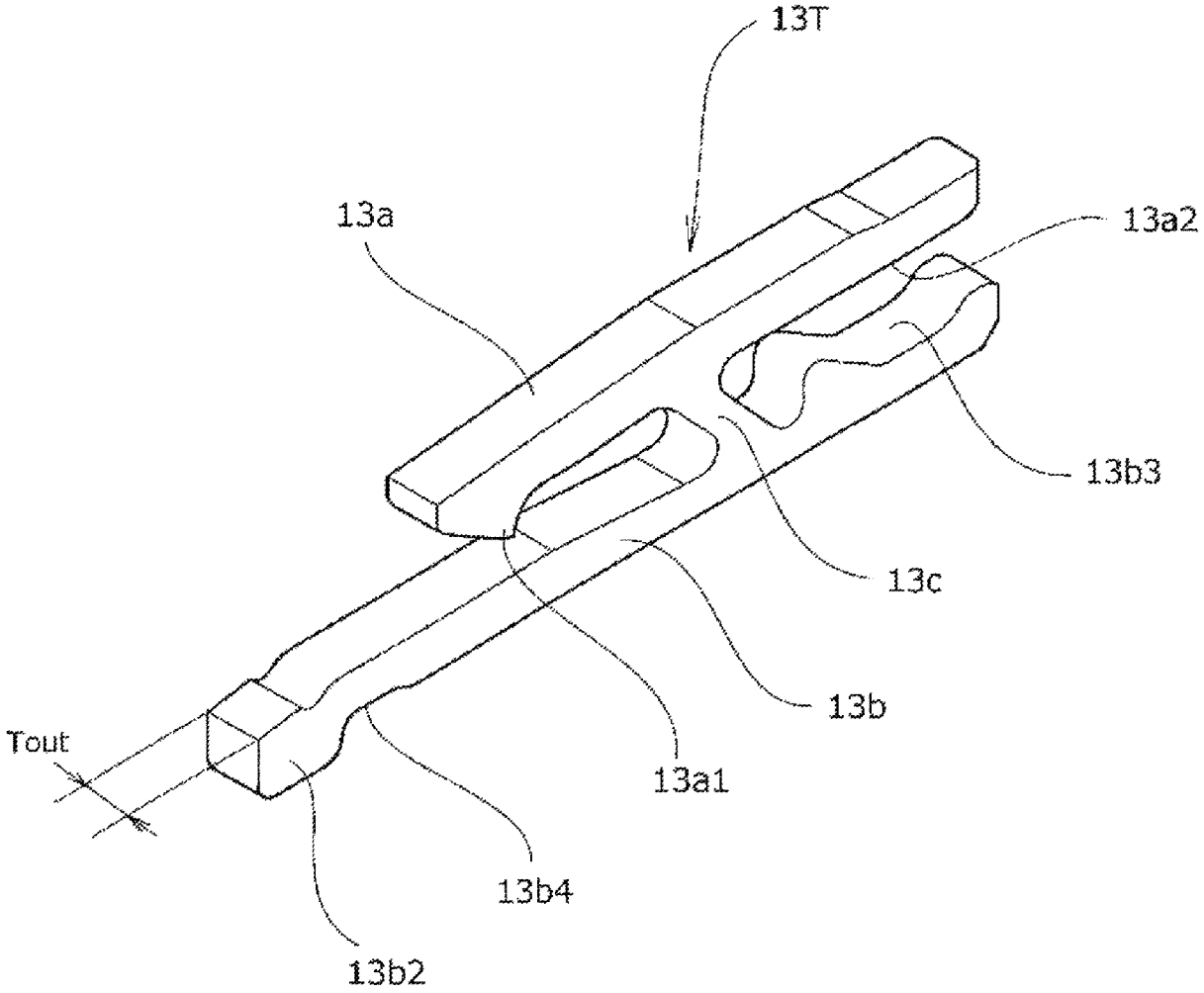
FIG. 11 is an enlarged external perspective explanatory drawing illustrating a thickness-increased first thick-walled conductive contact member of the first conductive contact member illustrated in FIG. 9 from the connector front side.
Figure 12:
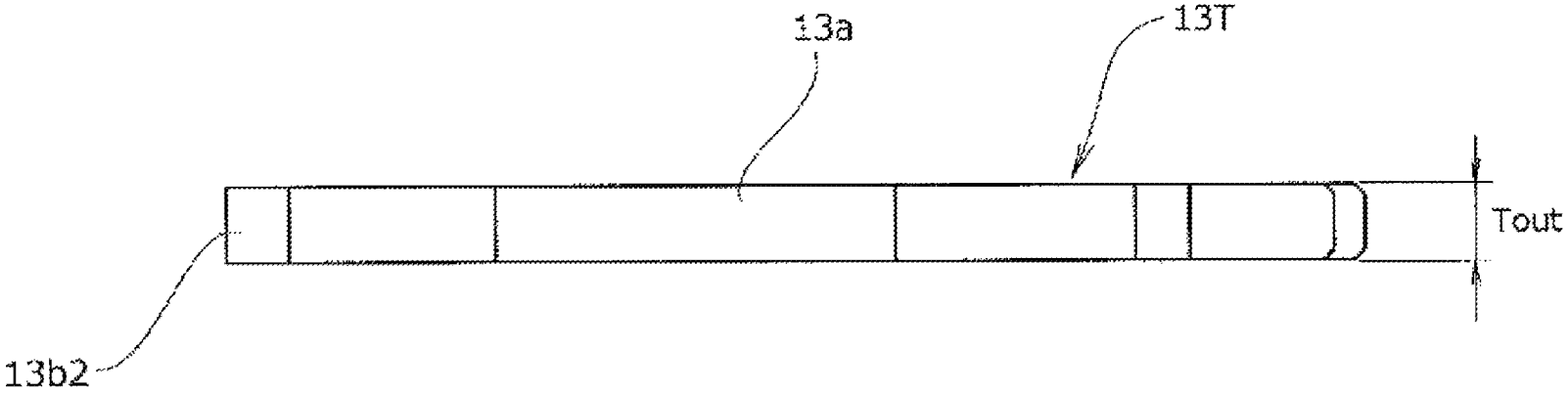
FIG. 12 is an enlarged plan explanatory drawing at a time when the first thick-walled conductive contact member illustrated in FIG. 11 is seen from above.
Figure 13:
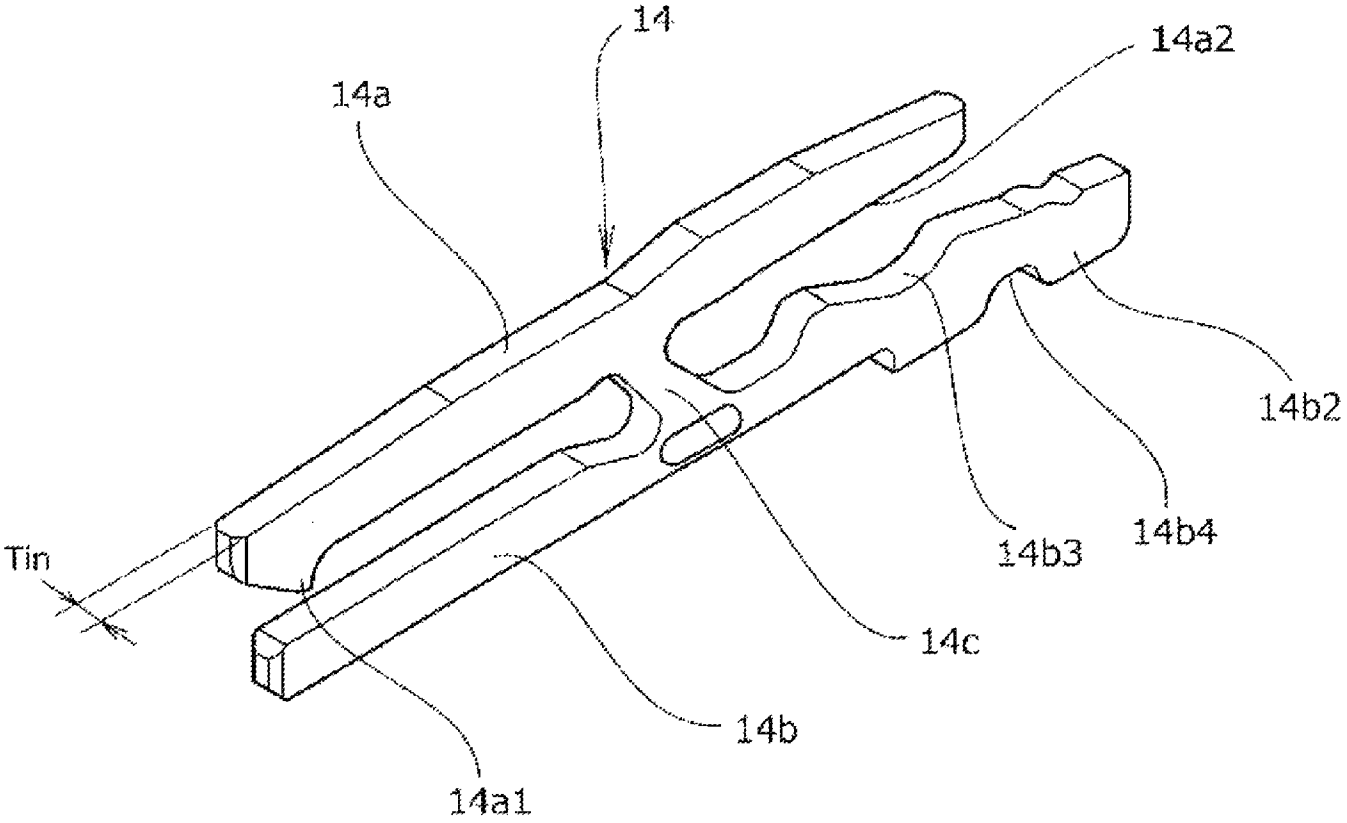
FIG. 13 is an enlarged external perspective explanatory drawing illustrating a second conductive contact member used in the electric connector according to the embodiment of the present invention illustrated in FIGS. 1 to 8 from the connector front side.
Figure 14:
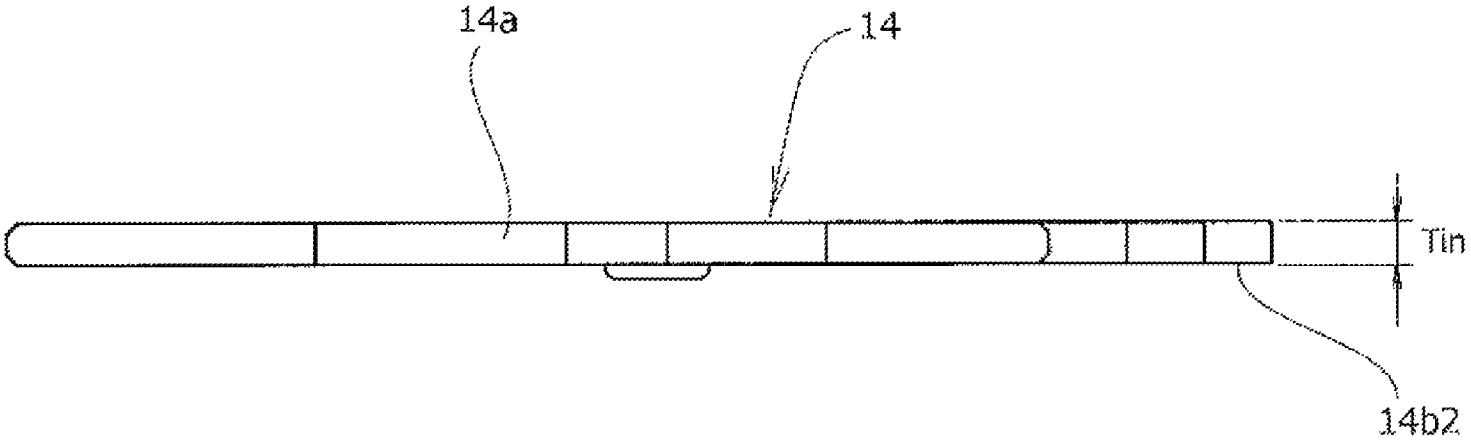
FIG. 14 is an enlarged plan explanatory drawing at a time when the second conductive contact member illustrated in FIG. 13 is seen from above.
Figure 15:
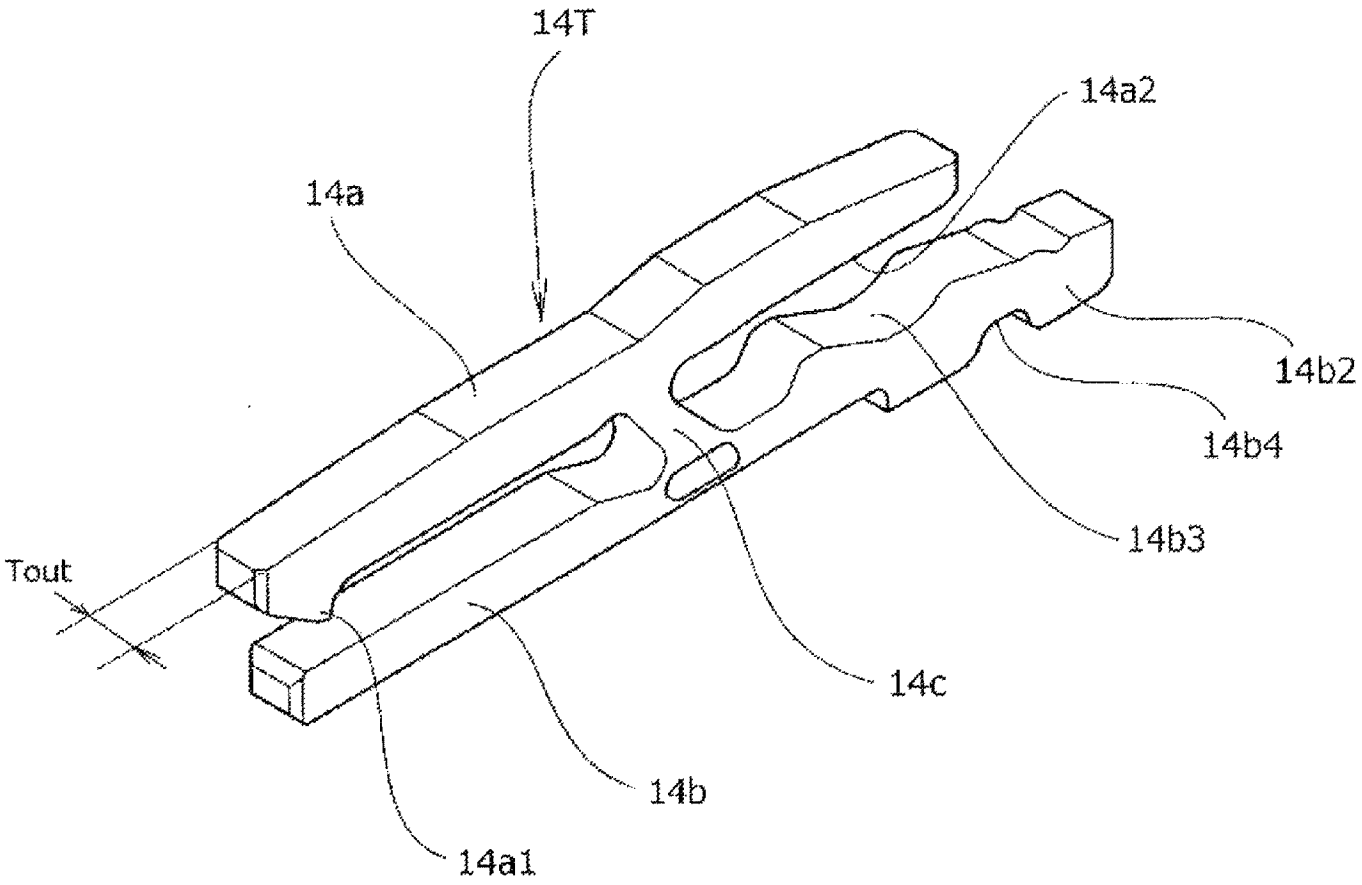
FIG. 15 is an enlarged external perspective explanatory drawing illustrating a thickness-increased second thick-walled conductive contact member of the second conductive contact member illustrated in FIG. 13 from the connector front side.
Figure 16:
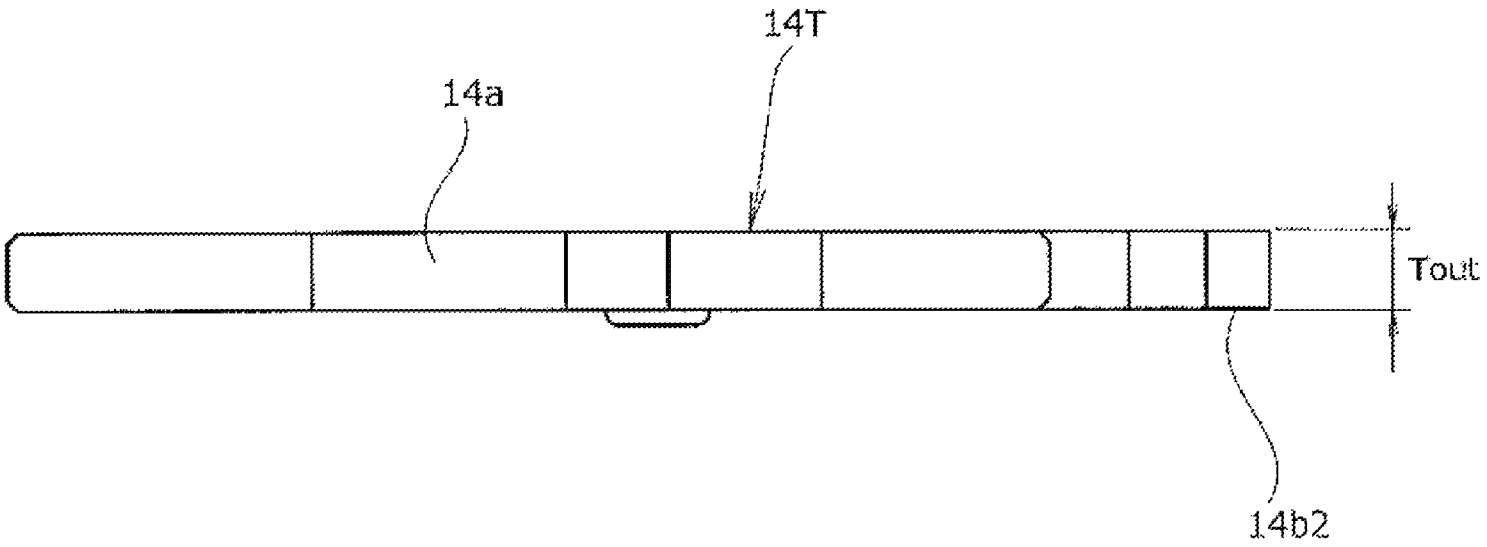
FIG. 16 is an enlarged side explanatory drawing in which the second thick-walled conductive contact member illustrated in FIG. 15 is illustrated in side view.

Each of the first conductive contact members 13 has an upper beam 13*a* and a lower beam 13*b*, each of the second conductive contact members 14 has an upper beam 14*a* and a lower beam 14*b*, a pair of elongated beam members constitutes the upper beam 13*a* and the lower beam 13*b*, a pair of elongated beam members constitutes the upper beam 14*a* and the lower beam 14*b*, and the beam members extend substantially in parallel along the "connector front-rear direction", which is the insertion and extraction direction of the flat plate-shaped signal transmission medium (FPC, FFC, or the like) F (left-right direction in FIGS. 5 and 6). The upper beams 13*a* and 14*a* and the lower beams 13*b* and 14*b* are disposed to face each other at appropriate intervals in the "up-down direction" in the internal space of the insulating housing 11 described above. The lower beams 13*b* and 14*b* are disposed to be in a substantially immovable state along the inner wall surface of the bottom surface plate of the insulating housing 11, and the movable upper beams 13*a* and 14*a* are integrally connected to the lower beams 13*b* and 14*b* described above via connecting post portions 13*c* and 14*c* extending upward from the extension-direction halfway positions of the lower beams 13*b* and 14*b*.

The connecting post portions 13*c* and 14*c* are formed of narrow plate-shaped members and disposed to extend in the up-down direction at the substantially middle parts of both the beams 13*a* and 14*a* and the beams 13*b* and 14*b* described above in the extension direction. In this configuration, the upper beams 13*a* and 14*a* are elastically displaced to respectively oscillate about the connecting post portions 13*c* and 14*c* or the vicinities thereof as the centers of rotation because of the elastic flexibility of the connecting post portions 13*c* and 14*c* and both the beams 13*a* and 14*a* and the beams 13*b* and 14*b*, and each of the lower beams 13*b* and 14*b* is also elastically displaced with the elastic displacement. The oscillation of the upper beams 13*a* and 14*a* and the lower beams 13*b* and 14*b* at that time is performed in the up-down direction in the page of FIGS. 5 and 6.

Upper terminal contact protruding portions 13*a*1 and 14*a*1, which are connected to any one of the transmission patterns (wiring land portions for signal transmission or shielding) Fa formed on the illustrated upper surface side of the flat plate-shaped signal transmission medium (FPC, FFC, or the like) F, are disposed to form the illustrated downward protruding shape at the front end side parts of the upper beams 13*a* and 14*a* described above (left end side parts in FIGS. 5 to 8).

Although the lower beams 13*b* and 14*b* are disposed to extend in the front-rear direction along the inner wall surface of the bottom surface plate of the insulating housing 11, the flat plate-shaped signal transmission medium (FPC, FFC, or the like) F inserted into the insulating housing 11 is disposed such that the lower side surface of the flat plate-shaped signal transmission medium F comes into contact with the upper edges of the lower beams 13*b* and 14*b* described above. In addition, the upper terminal contact protruding portions 13*a*1 and 14*a*1 of the upper beams 13*a* and 14*a* described above are brought into contact with the upper side surface of the flat plate-shaped signal transmission medium F such that the upper side surface is pressed from above. Clamping of the flat plate-shaped signal transmission medium F is performed by the lower beams 13*b* and 14*b* and the upper beams 13*a* and 14*a* being put into a pressure-welded state for sandwiching from both sides with respect to both the upper side surface and the lower side surface of the flat plate-shaped signal transmission medium F as described above (refer to FIGS. 18 to 20). The clamping operation for the flat plate-shaped signal transmission medium F will be described in detail later.

In a case where the transmission pattern is formed on the lower surface side surface of the flat plate-shaped signal transmission medium (FPC, FFC, or the like) F, lower terminal contact protruding portions are disposed at the front side parts of the lower beams 13*b* and 14*b* described above (left side parts in FIGS. 5 and 6) such that the upward protruding shape is formed.

In addition, the upper terminal contact protruding portions 13*a*1 and 14*a*1 of the upper beams 13*a* and 14*a* can also be disposed with relative positions with respect to the lower beams 13*b* and 14*b* shifted to the connector front side (left side in FIGS. 5 and 6) or the connector rear side (right side in FIGS. 5 and 6). Although the lower beams 13*b* and 14*b* are basically disposed to be in the substantially immovable state, the lower beams 13*b* and 14*b* can be formed such that tip parts can be elastically displaced and the front end parts of the lower beams 13*b* and 14*b* can also be formed to float slightly from the inner wall surface of the bottom surface plate of the insulating housing 11 for the purpose of, for example, temporarily holding the flat plate-shaped signal transmission medium (FPC, FFC, or the like) F that is inserted.

Substrate connection portions 13*b*2 and 14*b*2 solder-connected to the wiring land portion (conductive path) formed on the printed wiring substrate are disposed at the rear end side part of the lower beam 13*b* described above (right end side part in FIGS. 5 and 6) and the front end side part of the lower beam 14*b* described above (left end side part in FIGS. 5 and 6), respectively. The substrate connection portions 13*b*2 and 14*b*2 are placed in a state of being aligned from above with respect to the wiring land portion (conductive path) on the printed wiring substrate and an electrical connection is performed thereon by collective joining work using a solder material.

In response to the solder bonding work with respect to the substrate connection portions 13*b*2 and 14*b*2, solder escape portions 13*b*4 and 14*b*4 including notch-shaped gap portions are formed at back side positions somewhat drawn in the connector front-rear direction from the tips of the substrate connection portions 13*b*2 and 14*b*2. The solder escape portions 13*b*4 and 14*b*4 are parts stopping a flow of the solder material put into a molten state during the solder bonding work, the flow of the solder material is stopped by the fillet of the solder material being formed to stand up in the corner portions close to the substrate connection portions 13*b*2 and 14*b*2 in the recessed space portions forming the solder escape portions 13*b*4 and 14*b*4, and a state where there is no wraparound of the solder material is maintained with respect to the other recessed space parts of the solder escape portions 13*b*4 and 14*b*4.

Furthermore, cam pressure receiving portions 13*a*2 and 14*a*2 extending to form substantially flat lower edges are disposed at the rear end side parts of the upper beams 13*a* and 14*a* (right end side parts in FIGS. 5 and 6), and cam slip receiving recessed portions 13*b*3 and 14*b*3 formed to form recessed upper edges are disposed at the rear end side parts of the lower beams 13*b* and 14*b* (right end side parts in FIGS. 5 and 6), respectively. The lower half side part of a pressing cam portion 12*a* of the actuator (connection operation means) 12 mounted at the rear end part of the insulating housing 11 described above is disposed to be received in a state of being slidable from above with respect to the cam slip receiving recessed portions 13*b*3 and 14*b*3 of the lower beams 13*b* and 14*b*, and the actuator 12 is supported to be rotatable around the center of rotation of the pressing cam portion 12*a* by the slidable contact disposition relationship in this configuration.

A cam surface is formed on the outer periphery of the pressing cam portion 12*a* described above, and the cam pressure receiving portions 13*a*2 and 14*a*2 of the upper beams 13*a* and 14*a* are disposed to approach or come into contact with the cam surface formed at the upper half side part of the pressing cam portion 12*a* from the upper side.

Based on recent requests for smaller electronic equipment, the electric connector 10 according to the present embodiment has a structure in which the length in the connector longitudinal direction, which is the arrangement direction of the multipolar shape, is kept to a minimum. More specifically, in this structure, the thicknesses of the first and second conductive contact members 13 and 14 in the arrangement direction of the multipolar shape are reduced, and the arrangement pitch of the first and second conductive contact members 13 and 14 is reduced and the overall length in the connector longitudinal direction is reduced as a result. After the thicknesses of the first and second conductive contact members 13 and 14 are reduced, the allowable current value of a transmission signal tends to decrease and the supply allowable electric power with respect to the electric connector 10 tends to decrease due to an increase in the conductor resistance of the first and second conductive contact members 13 and 14.

In this regard, in the present embodiment, at least one of the plurality of first and second conductive contact members 13 and 14 is formed thicker than the rest of the contact members on the assumption of a case where a relatively large supply electric power is given. More specifically, first and second conductive contact members 13T and 14T disposed at the outermost end positions on both sides in the arrangement direction of the multipolar shape (connector longitudinal direction) have an increased thickness among the plurality of first and second conductive contact members 13 and 14 arranged in the multipolar shape. The other conductive contact members 13 and 14 forming a thin-walled shape are configured to be disposed to be sandwiched at the part between the first and second thick-walled conductive contact members 13T and 14T disposed at the outermost end positions on both sides.

A thickness Tout (refer to FIGS. 11, 12, 15, and 16) of the first and second thick-walled conductive contact members 13T and 14T disposed at the outermost end positions on both sides in the arrangement direction of the multipolar shape (connector longitudinal direction) as described above is set to approximately twice a thickness Tin (refer to FIGS. 9, 10, 13, and 14) of the other first and second thin-walled conductive contact members 13 and 14 (Tout≅2Tin). Although the thickness Tout of the first thick-walled conductive contact member 13T and the thickness Tout of the second thick-walled conductive contact member 14T are set to the same thickness dimension in the present embodiment, the thickness Tout of the first thick-walled conductive contact member 13T and the thickness Tout of the second thick-walled conductive contact member 14T can be set to different thickness dimensions as well.

In addition, the thickness-increased first thick-walled conductive contact member 13T described above and the other first thin-walled conductive contact member 13 have the same shape when seen in the arrangement direction of the multipolar shape and, likewise, the second thick-walled conductive contact member 14T and the other second thin-walled conductive contact member 14 have the same shape when seen in the arrangement direction of the multipolar shape. As a result of this configuration, all of the conductive contact members 13 and 14 can be assembled in the same manner regardless of the different thicknesses.

Furthermore, the first and second conductive contact members 13 and 14 according to the present embodiment are formed in any one of the two types of shapes described above regardless of the different thicknesses as described above, and thus a disposition relationship similar to existing ones can be achieved even in a case where the thickness-increased first and second thick-walled conductive contact members 13T and 14T are disposed to be mixed with the other first and second thin-walled conductive contact members 13 and 14. A configuration of so-called staggered arrangement in which those having different shapes in the arrangement direction of the multipolar shape (connector longitudinal direction) are alternately disposed as in the present embodiment can be adopted.

According to the configuration of the conductive contact members 13 and 14 according to the present embodiment as described above, the conductor resistance of the thickness-increased first and second thick-walled conductive contact members 13T and 14T disposed at the outer ends on both sides is reduced in accordance with an increment in thickness, and thus the energization allowable electric power of the transmission signal is increased and the total number of the conductive contact members 13 and 14 does not have to be increased even in a case where the supply electric power with respect to the electric connector 10 is large. Accordingly, an increase in the size of the electric connector 10 such as lengthening and heightening can be suppressed.

The contact portions of the first and second thick-walled conductive contact members 13T and 14T, that is, the upper terminal contact protruding portions 13*a*1 and 14*a*1 of the upper beams 13*a* and 14*a* and the upper edges of the lower beams 13*b* and 14*b* that have an increased thickness are pressure-welded with respect to the surface of the flat plate-shaped signal transmission medium (FPC, FFC, or the like) F inserted into the insulating housing 11, and thus the contact pressure of the conductive contact members 13 and 14 with respect to the flat plate-shaped signal transmission medium F increases, and the retention of the flat plate-shaped signal transmission medium F is enhanced as a result.

Especially in the present embodiment, the two first and second thick-walled conductive contact members 13T and 14T disposed at the outermost ends on both sides in the arrangement direction of the multipolar shape (connector longitudinal direction) as described above are disposed to sandwich the other thin-walled conductive contact members 13 and 14 in the arrangement direction of the multipolar shape, and thus the contact portions of the first and second thick-walled conductive contact members 13T and 14T that have a relatively large contact pressure are put into a pressure-welded state with respect to the flat plate-shaped signal transmission medium (FPC, FFC, or the like) F at the positions on both sides where the other thin-walled conductive contact members 13 and 14 are sandwiched (outermost end positions). As a result, misalignment such as rotation of the flat plate-shaped signal transmission medium F is prevented in a satisfactory manner in a plane including the surface of the flat plate-shaped signal transmission medium F.

Furthermore, gaps S1 and S2 allowing the flat plate-shaped signal transmission medium (FPC, FFC, or the like) F to be inserted are formed between a pair of the contact portions disposed in the conductive contact members 13 and 14, that is, the upper edges of the lower beams 13*b* and 14*b* and the upper terminal contact protruding portions 13*a*1 and 14*a*1 of the upper beams 13*a* and 14*a* as illustrated in FIGS. 5 and 6. In the present embodiment, the gaps S1 and S2 formed in the thickness-increased first and second thick-walled conductive contact members 13T and 14T are set equal to or less than a thickness Tf (refer to FIGS. 19 and 20) of the connector insertion part of the flat plate-shaped signal transmission medium F (S1, S2≤Tf).

According to the configuration of the present embodiment as described above, immediately after the flat plate-shaped signal transmission medium (FPC, FFC, or the like) F is inserted into the insulating housing 11, the flat plate-shaped signal transmission medium (FPC, FFC, or the like) F is immediately put into a state of abutting with respect to the contact portions of the thickness-increased first and second thick-walled conductive contact members 13T and 14T, and thus the flat plate-shaped signal transmission medium F is temporarily held by the relatively large contact pressure of the contact portions of the first and second thick-walled conductive contact members 13T and 14T. As a result, the flat plate-shaped signal transmission medium F is stably held between the insertion of the flat plate-shaped signal transmission medium F and the completion of the clamping.

Figure 18:
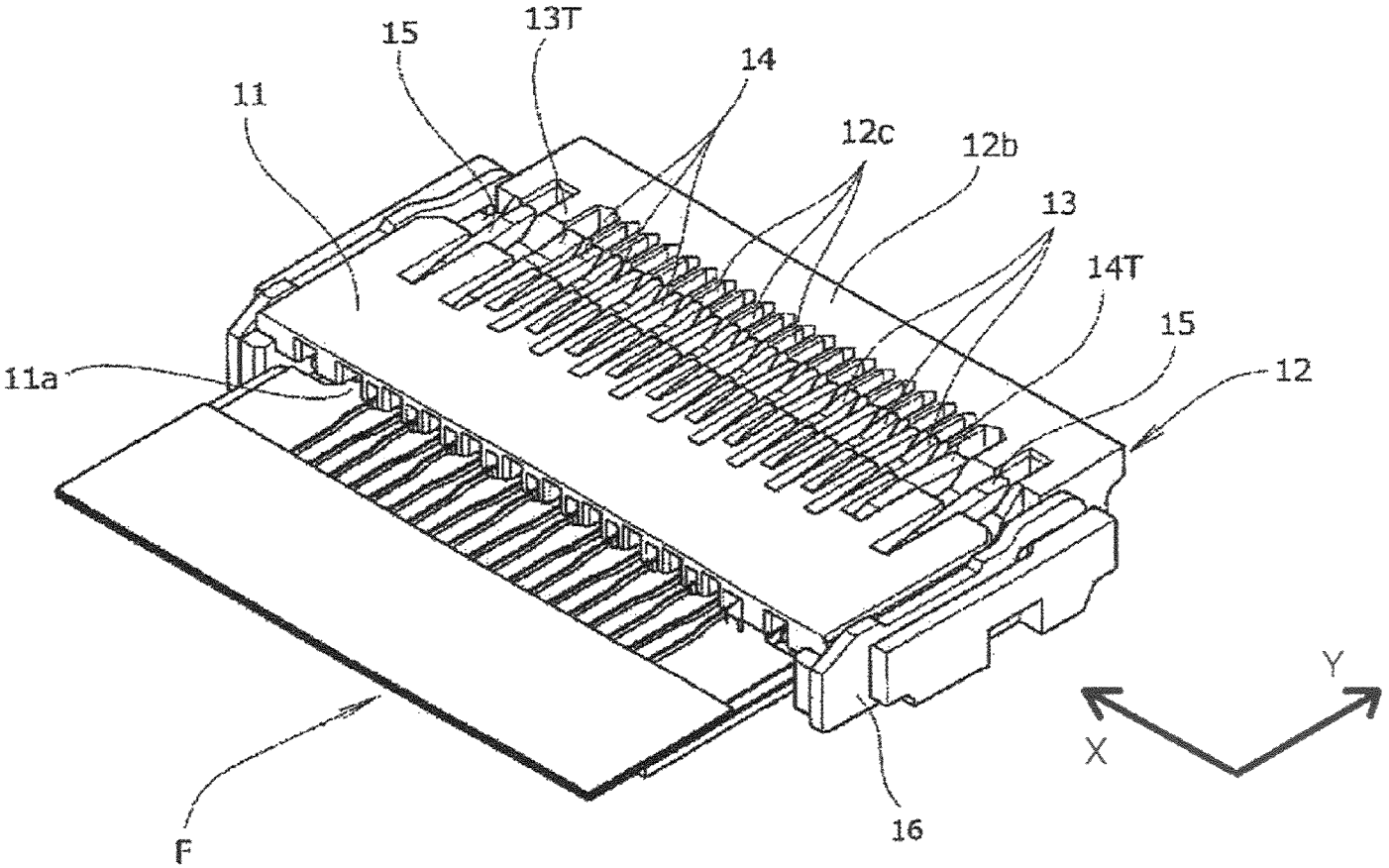
FIG. 18 is an external perspective explanatory drawing illustrating a clamping state following the insertion of the terminal part of the flat plate-shaped signal transmission medium (FPC, FFC, or the like) with respect to the electric connector according to the present invention.
Figure 19:
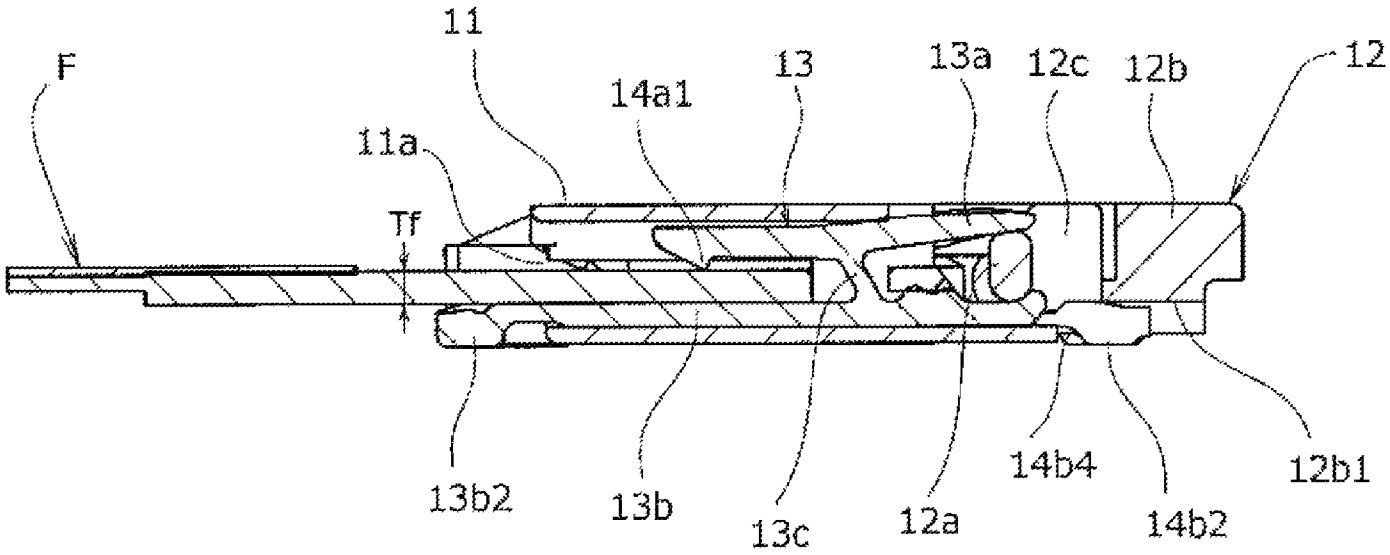
FIG. 19 is a cross-sectional explanatory drawing, which is equivalent to FIG. 5, of the clamping state following the insertion of the terminal part of the flat plate-shaped signal transmission medium (FPC, FFC, or the like) with respect to the electric connector according to the present invention.
Figure 20:
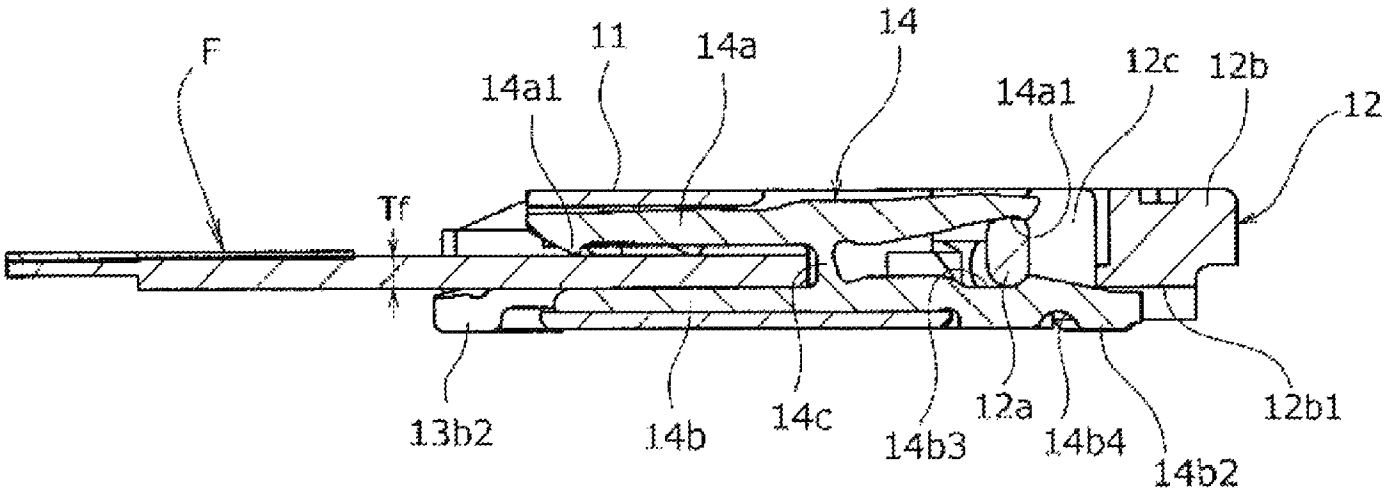
FIG. 20 is a cross-sectional explanatory drawing, which is equivalent to FIG. 6, of the clamping state following the insertion of the terminal part of the flat plate-shaped signal transmission medium (FPC, FFC, or the like) with respect to the electric connector according to the present invention.

The entire actuator (connection operation means) 12 disposed to be rotated at the rear end part of the insulating housing 11 (right end side part in FIGS. 5 and 6) as described above is formed to extend in an elongated shape along the connector longitudinal direction and disposed over almost the same length as the full width of the insulating housing 11. The actuator 12 is mounted to be rotatable around the center of rotation extending in the longitudinal direction of the actuator 12, that is, the center of rotation of the pressing cam portion 12*a* described above, and the outer side part of the radius of rotation thereof (upper side part in FIGS. 5 and 6) is an opening and closing operation portion 12*b*. The actuator 12 is configured such that the entire actuator 12 performs reciprocating rotation between an "initial standby position" where the entire actuator 12 is in a substantially upright state as illustrated in FIGS. 1 to 8 and 17 and an "operation clamping position" where the entire actuator 12 is in a state of being substantially horizontally tumbled toward the connector rear side as illustrated in FIGS. 18 to 20 by a worker giving an appropriate operating force with respect to the opening and closing operation portion 12*b*.

At the part of the opening and closing operation portion 12*b* of the actuator (connection operation means) 12 on the center of rotation side that is connected to the pressing cam portion 12*a* described above, a plurality of slit holes 12*c* is formed in parallel at regular intervals along the "connector longitudinal direction" X (see FIG. 18) to form a comb-teeth shape so that the first and second conductive contact members 13 and 14 do not interfere with the upper beams 13*a* and 14*a*. The slit holes 12*c* are formed to penetrate the opening and closing operation portion 12*b* of the actuator 12 in the "connector front-rear direction" Y (see FIG. 18) at positions corresponding to the conductive contact members 13 and 14.

The rear end parts of the upper beams 13*a* and 14*a* constituting the first and second conductive contact members 13 and 14 are inserted toward the inside of the slit holes 12*c* described above when the actuator 12 is disposed to stand up from the wiring substrate by the actuator (connection operation means) 12 being rotated from the "operation clamping position" (refer to FIGS. 18 to 20) toward the "initial standby position" (refer to FIGS. 1 to 8 and 17). The insertion at this time is performed from an operation portion front surface, which is the front side of the opening and closing operation portion 12*b* of the actuator 12, and the rear end parts of the upper beams 13*a* and 14*a* are put into a state of protruding outward (rearward) from an operation portion back surface 12*b*1, which is the back side of the opening and closing operation portion 12*b* of the actuator 12, after penetrating the slit holes 12*c*.

Once a worker performs a rotation operation with his or her hand such that the opening and closing operation portion 12*b* of the actuator (connection operation means) 12 is pushed down toward the "operation clamping position" (refer to FIGS. 18 to 20) from the "initial standby position" (refer to FIGS. 1 to 8 and 17), the radius of rotation of the pressing cam portion 12*a* described above changes to increase between the lower beams 13*b* and 14*b* and the upper beams 13*a* and 14*a* in this configuration. As the diameter of the pressing cam portion 12*a* changes to increase, the cam pressure receiving portions 13*a*2 and 14*a*2 disposed on the rear end sides of the upper beams 13*a* and 14*a* are displaced to be lifted to the illustrated upper side, and the upper terminal contact protruding portions 13*a*1 and 14*a*1 disposed on the side (connector front end side) opposite to the cam pressure receiving portions 13*a*2 and 14*a*2 are pushed downward as a result.

Although the clamping of the flat plate-shaped signal transmission medium (FPC, FFC, or the like) F inserted between the upper terminal contact protruding portions 13*a*1 and 14*a*1 of the upper beams 13*a* and 14*a* and the upper edges of the lower beams 13*b* and 14*b* described above is performed when the actuator (connection operation means) 12 is completely rotated to the "operation clamping position" as the final rotation position in this manner (refer to FIGS. 18 to 20), the upper terminal contact protruding portions 13*a*1 and 14*a*1 of the upper beams 13*a* and 14*a* are pressure-welded to the wiring land portions (wiring land portions for signal transmission and shielding) Fa of the flat plate-shaped signal transmission medium F in this clamping state, and electrical connection is performed in this configuration as a result.

At this time, lock members 15 and 15 formed of elongated plate-shaped metal members are mounted on the insulating housing 11 on the further outer sides in the same direction of the first and second conductive contact members 13 and 14 disposed at both side parts in the "connector longitudinal direction". The lock members 15 and 15 are disposed to extend substantially in parallel with respect to the first and second conductive contact members 13 and 14 described above and have locking projections (not illustrated) that can be engaged with respect to positioning recessed portions Fb and Fb (refer to FIG. 19) formed in both side edge portions of the flat plate-shaped signal transmission medium (FPC, FFC, or the like) F. The lock members 15 and 15 described above are elastically displaced to be engaged with the positioning recessed portions Fb and Fb (refer to FIG. 17) of the signal transmission medium F by the actuator (connection operation means) 12 undergoing a rotation operation to the "operation clamping position" (refer to FIGS. 10 to 18), and the signal transmission medium F is held as a result not to escape from the final insertion position.

In addition, fixed metal fittings 16 and 16 formed of elongated plate-shaped metal members are mounted on the insulating housing 11, at both side outer parts in the "connector longitudinal direction", with respect to the lock members 15 and 15 described above. The fixed metal fittings 16 and 16 have a disposition relationship of extending substantially in parallel with respect to the conductive contact members 13 and 14 and the lock member 15 described above, and solder fixing portions 16*a* and 16*a* placed and solder-bonded on a fixed pad (not illustrated) formed on a printed wiring substrate P are disposed at both end parts in the extension direction thereof.

Although the operation portion back surface of the opening and closing operation portion 12*b* of the actuator 12 is disposed to form a lower surface extending substantially in parallel with respect to the mounting surface of the printed wiring substrate in a state where the actuator (connection operation means) 12 is completely rotated to the "operation clamping position" as described above (refer to FIGS. 18 to 20), the operation portion back surface of the actuator 12 in this case has a relationship of being positioned on the upper side of the rear end part of the lower beam 14*b* constituting the second conductive contact member 14 in the extension direction, that is, the upper side of a substrate connection portion 14*b*2.

A protective projection portion 12*b*2 (refer to FIGS. 5 and 6) protruding from the operation portion back surface described above is disposed in the opening and closing operation portion 12*b* of the actuator (connection operation means) 12. In other words, the protective projection portion 12*b*2 is formed to protrude from the operation portion back surface of the actuator 12 toward the connector rear side when the actuator 12 is at the "initial standby position" and disposed at the part between a pair of the first and second conductive contact members 13 and 14 next to each other in the arrangement direction of the multipolar shape (connector longitudinal direction).

More specifically, the protective projection portion 12*b*2 disposed to protrude on the operation portion back surface of the actuator (connection operation means) 12 as described above is configured to be disposed between the upper beam 13*a* of the first conductive contact member 13 and the upper beam 14*a* of the second conductive contact member 14 when the actuator 12 is disposed at the "initial standby position" (refer to FIGS. 1 to 8 and 17) to stand up from the printed wiring substrate, and the upper beam 13*a*, the protective projection portion 12*b*2, and the upper beam 14*a* have a disposition relationship of being in parallel in the arrangement direction of the multipolar shape (connector longitudinal direction) by the protective projection portion 12*b*2 being disposed to be next to each other in the arrangement direction of the multipolar shape (connector longitudinal direction) with respect to the rear end parts of a pair of the upper beams 13*a* and 14*a*.

The protruding height of the protective projection portion 12*b*2 in a state where the actuator (connection operation means) 12 is disposed at the "initial standby position" (refer to FIGS. 1 to 8 and 17) as described above, that is, the protruding height at a time when the operation portion back surface of the actuator 12 is a reference plane is set equal to or slightly greater than the height by which the rear end parts of the upper beams 13*a* and 14*a* protrude from the operation portion back surface as the reference plane. In other words, although the rear end parts of the upper beams 13*a* and 14*a* of the conductive contact members 13 and 14 at a time when the actuator 12 is disposed at the "initial standby position" to stand up from the printed wiring substrate protrude outward (rearward) from the operation portion back surface 12*b*1 of the actuator 12, the protruding tip portions of the upper beams 13*a* and 14*a* are disposed at the same position as or a position that is more retracted than the protruding tip portion of the protective projection portion 12*b*2 disposed on the actuator 12 side. As a result, a rotation operator's fingertips and nails are not caught by the rear end parts of the upper beams 13*a* and 14*a* of the first and second conductive contact members 13 and 14, although the fingertips and nails may abut against the protective projection portion 12*b*2 of the actuator 12, and deformation, breakage, and so on during the rotation operation of the conductive contact members 13 and 14 are prevented.

Although the protective projection portion 12*b*2 disposed on the operation portion back surface of the opening and closing operation portion 12*b* of the actuator (connection operation means) 12 is put into a state of protruding toward the lower side that is the printed wiring substrate side when the actuator 12 is rotation-operated to the "operation clamping position" (refer to FIGS. 18 to 20), the protective projection portion 12*b*2 at that time has a disposition relationship of being positioned above a solder escape portion 13*b*4 disposed in the first conductive contact member 13. In other words, the solder material does not turn in the solder escape portions 13*b*4 and 14*b*4 in a case where solder bonding of the conductive contact members 13 and 14 is performed, and thus the protective projection portion 12*b*2 of the actuator 12 does not come into contact with the solder material and the reliability of the solder bonding is ensured, even in a case where the actuator 12 is rotated to the "operation clamping position", insofar as the protective projection portion 12*b*2 has a disposition relationship of being positioned above the solder escape portion 13*b*4 disposed in the first conductive contact member 13 as described above.

Although the invention made by the present inventor has been described in detail based on the embodiment above, it is a matter of course that the present invention is not limited to the embodiment described above and can be modified in various forms within the scope not departing from the gist of the present invention.

For example, although the embodiment described above has a configuration in which the two conductive contact members disposed at the outermost end positions on both sides in the arrangement direction of the multipolar shape (connector longitudinal direction) have an increased thickness, any one of all of the conductive contact members may have an increased thickness and be formed in a thick-walled shape instead in the present invention.

Although a pair of conductive contact members having different shapes has an increased thickness in the embodiment described above, a configuration in which a plurality of (at least three) conductive contact members has an increased thickness can also be adopted. Likewise, a configuration in which a pair or plurality of conductive contact members having the same shape has an increased thickness can also be adopted.

Although conductive contact members that have different shapes are used in the electric connector according to the embodiment described above, the present invention can be similarly applied with respect to an electric connector using conductive contact members that have the same shape as well.

Although a flexible printed circuit (FPC) and a flexible flat cable (FFC) are adopted as the flat plate-shaped signal transmission medium that is inserted into the electric connector according to the embodiment described above, the present invention can be similarly applied with respect to a case where another medium for signal transmission or the like is used as well.

Although an actuator undergoing a rotation operation constitutes the connection operation means according to the embodiment described above, the present invention can be similarly applied with respect to an electric connector that has connection operation means undergoing a slide operation as well. Likewise, the present invention can be similarly applied with respect to an electric connector in which connection operation means (actuator) is disposed at a front end side part and an electric connector in which connection operation means (actuator) is disposed at a part between a front end side part and a rear end side part as well, and the rotation direction or slide direction of the connection operation means (actuator) at that time may be either a front side or a rear side.

INDUSTRIAL APPLICABILITY

The present invention can be widely applied with respect to a variety of electric connectors used in various types of electrical equipment.

REFERENCE SIGNS LIST

10 Electric connector
11 Insulating housing

11*a* Medium insertion port
12 Actuator (connection operation means)
12*a* Pressing cam portion
12*b* Opening and closing operation portion
12*b*2 Protective projection portion
12*c* Slit hole
13, 14 First and second conductive contact members
13T, 14T First and second thick-walled conductive contact members
13*a*, 14*a* Movable upper beam
13*a*1, 14*a*1 Upper terminal contact protruding portion
13*a*2, 14*a*2 Cam pressure receiving portion
13*b*3, 14*b*3 Cam slip receiving recessed portion
13*b*, 14*b* Fixed lower beam
13*b*4, 14*b*4 Solder escape portion
13*c*, 14*c* Connecting post portion
15 Lock member
16 Fixed metal fitting
16*a* Solder fixing portion
F Flat plate-shaped signal transmission medium (FPC, FFC, or the like)
Fa Transmission pattern
Fb Positioning recessed portion

The invention claimed is:

1. An electric connector comprising:

a plurality of contact members mounted on an insulating housing, the plurality of contact members arranged along a longitudinal direction of the insulating housing, the electric connector being configured such that clamping of a flat plate-shaped signal transmission medium is performed by a pair of contact portions disposed in the contact members which are pressure-welded to opposite sides of the flat plate-shaped signal transmission medium inserted into the insulating housing, the pair of contact portions sandwiching the flat plate-shaped signal transmission medium; and two elongated plate-shaped lock members including a first lock member and a second lock member, wherein the plurality of contact members comprises a pair of thicker contact members as compared to other contact members in the plurality of contact members to provide an increased contact pressure in clamping the flat plate-shaped signal transmission medium, wherein the other contact members are located between the pair of thicker contact members, in the longitudinal direction of the insulating housing, and wherein the other contact members are additionally located between the first lock member and the second lock member, in the longitudinal direction of the insulating housing.

2. The electric connector according to claim 1, wherein a gap S between the pair of contact portions disposed in the pair of thicker contact members is set equal to or less than a thickness T of the flat plate-shaped signal transmission medium ($S \leq T$).

3. The electric connector according to claim 1, wherein the other contact members and the pair of thicker contact members have an identical shape when viewed along the longitudinal direction of the insulating housing.

4. The electric connector according to claim 1, wherein each of the plurality of contact members, including the other contact members and the pair of thicker contact members, is formed of any one of two types of contact members having different shapes when viewed along the longitudinal direction of the insulating housing.

5. An electric connector, comprising:

an insulating housing having a longitudinal direction;

a plurality of contact members connected to the insulating housing, each of the contact members comprising two contact portions, wherein the plurality of contact members comprises a pair of thicker contact members having a greater thickness as compared to other contact members as measured in the longitudinal direction of the insulating housing, and wherein the other contact members are located between the pair of thicker contact members in the longitudinal direction of the insulating housing;

a signal transmission device comprising a flat upper surface and a flat lower surface mounted to the plurality of contact members, the flat upper surface and the flat lower surface sandwiched between the two contact portions of the plurality of contact members including the pair of thicker contact members; and two lock members including a first lock member and a second lock member, wherein the two lock members are configured to become elastically displaced when engaging the signal transmission device, and wherein the other contact members are located between the first lock member and the second lock member, in the longitudinal direction of the insulating housing.

6. The electric connector according to claim 5, wherein the plurality of contact members connected to the insulating housing is arranged along the longitudinal direction of the insulating housing.

7. The electric connector according to claim 5, wherein the two contact portions are pressure-welded to the flat upper surface and to the flat lower surface of the signal transmission device.

8. The electric connector according to claim 5, wherein a gap between the two contact portions of the pair of thicker contact members is less than a distance between the flat upper surface and the flat lower surface of the signal transmission device.

9. The electric connector according to claim 5, wherein the pair of thicker contact members and the other contact members have an identical profile when viewed along the longitudinal direction of the insulating housing.

10. The electric connector according to claim 5, wherein the plurality of contact members consists of two types of profiles, and wherein contact members having one of the two types of profiles are connected to the insulating housing in the longitudinal direction of the insulating housing in a staggered arrangement, alternating between a first type of profile and a second type of profile.

11. The electric connector according to claim 5, wherein the plurality of contact members comprises three or more, of the thicker contact members which are thicker than the other contact members.

12. The electric connector according to claim 5, further comprising an actuator connected to the insulating housing and comprising a plurality of slit holes, wherein the actuator is configured to be rotated such that the slit holes penetrate opening and closing operation portions of the actuator at positions corresponding to the plurality of contact members.

13. The electric connector according to claim 5, wherein the signal transmission device comprises a flexible printed circuit or a flexible flat cable.

14. The electric connector according to claim 1, wherein the pair of thicker contact members have a substantially identical length as the other contact members as measured in a connector front-rear direction perpendicular to the longitudinal direction of the insulating housing.

15. The electric connector according to claim 1, wherein the pair of thicker contact members includes a first contact member located between the first lock member and the other contact members, and a second contact member located between the second lock member and the other contact members, in the longitudinal direction of the insulating housing.

16. The electric connector according to claim 1, further comprising an actuator connected to the insulating housing, wherein the two lock members are configured to become elastically displaced in order to engage the flat plate-shaped signal transmission medium in response to a rotational operation of the actuator.

17. The electric connector according to claim 16, wherein the two lock members are thicker than the other contact members in the longitudinal direction of the insulating housing.

18. The electric connector according to claim 5, wherein the pair of thicker contact members includes a first contact member located between the first lock member and the other contact members, and a second contact member located between the second lock member and the other contact members, and wherein the other contact members are connected to the insulating housing between the first contact member and the second contact member.

19. The electric connector according to claim 5, further comprising an actuator connected to the insulating housing, wherein the signal transmission device includes two recessed portions formed on opposite sides of the signal transmission device, and wherein the two lock members are configured to become elastically displaced in order to engage the two recessed portions in response to a rotational operation of the actuator.

20. The electric connector according to claim 5, wherein the pair of thicker contact members have an identical length as the other contact members as measured in a connector front-rear direction perpendicular to the longitudinal direction of the insulating housing.

21. The electric connector according to claim 20, wherein each of the plurality of contact members comprises:

an upper beam having an upper terminal contact protruding portion; and a lower beam having a substrate connection portion, wherein the lower beam is longer than the upper beam such that the substrate connection portion extends further away from the insulating housing in the connector front-rear direction as compared to the upper terminal contact protruding portion, and wherein the identical length of the plurality of contact members is with respect to an entire length of the lower beam.

22. The electric connector according to claim 21, further comprising an opening and closing operation portion coupled to the insulating housing and configured to be rotated between a closed position and an open position, wherein the opening and closing operation portion, in the closed position, extends further away from the insulating housing in the connector front-rear direction as compared to the substrate connection portion, and wherein the opening and closing operation portion includes a protective projection portion which, in the open position, extends further away from the insulating housing in the connector front-rear direction as compared to the upper terminal contact protruding portion.

23. The electric connector according to claim 22, further comprising a solder escape portion located on a portion of the lower beam between the protective projection portion and the substrate connection portion in the connector front-rear direction.

* * * * *